US008172992B2

(12) United States Patent
Prabhakar et al.

(10) Patent No.: US 8,172,992 B2
(45) Date of Patent: May 8, 2012

(54) WAFER ELECTROPLATING APPARATUS FOR REDUCING EDGE DEFECTS

(75) Inventors: Vinay Prabhakar, Fremont, CA (US); Bryan L. Buckalew, Tualatin, OR (US); Kousik Ganesan, Tualatin, OR (US); Shantinath Ghongadi, Wilsonville, OR (US); Zhian He, Beaverton, OR (US); Steven T. Mayer, Lake Oswego, OR (US); Robert Rash, Portland, OR (US); Jonathan D. Reid, Sherwood, OR (US); Yuichi Takada, Tualatin, OR (US); James R. Zibrida, Portland, OR (US)

(73) Assignee: Novellus Systems, Inc., San Jose, CA (US)

( * ) Notice: Subject to any disclaimer, the term of this patent is extended or adjusted under 35 U.S.C. 154(b) by 266 days.

(21) Appl. No.: 12/633,219

(22) Filed: Dec. 8, 2009

(65) Prior Publication Data

US 2010/0155254 A1 Jun. 24, 2010

Related U.S. Application Data

(60) Provisional application No. 61/121,460, filed on Dec. 10, 2008.

(51) Int. Cl.
*C25B 9/02* (2006.01)

(52) U.S. Cl. ..... 204/297.09; 204/297.1; 204/297.14; 204/297.08

(58) Field of Classification Search ..... 204/297.09, 204/297.1, 297.14, 297.08
See application file for complete search history.

(56) References Cited

U.S. PATENT DOCUMENTS

| | | | |
|---|---|---|---|
| 4,466,864 | A | 8/1984 | Bacon et al. |
| 5,000,827 | A | 3/1991 | Schuster et al. |
| 5,221,449 | A | 6/1993 | Colgan et al. |
| 5,227,041 | A | 7/1993 | Brogden et al. |
| 5,281,485 | A | 1/1994 | Colgan et al. |
| 5,482,611 | A | 1/1996 | Helmer et al. |
| 5,853,559 | A | 12/1998 | Tamaki et al. |
| 5,985,762 | A | 11/1999 | Geffken et al. |
| 6,074,544 | A | 6/2000 | Reid et al. |
| 6,099,702 | A | 8/2000 | Reid et al. |
| 6,110,346 | A | 8/2000 | Reid et al. |

(Continued)

FOREIGN PATENT DOCUMENTS

WO 99/41434 8/1999

(Continued)

OTHER PUBLICATIONS

U.S. Office Action, mailed May 15, 2003 for U.S. Appl. No. 09/927,741.

(Continued)

*Primary Examiner* — Bruce Bell
(74) *Attorney, Agent, or Firm* — Weaver Austin Villeneuve & Sampson LLP

(57) ABSTRACT

Methods, apparatuses, and various apparatus components, such as base plates, lipseals, and contact ring assemblies are provided for reducing contamination of the contact area in the apparatuses. Contamination may happen during removal of semiconductor wafers from apparatuses after the electroplating process. In certain embodiments, a base plate with a hydrophobic coating, such as polyamide-imide (PAI) and sometimes polytetrafluoroethylene (PTFE), are used. Further, contact tips of the contact ring assembly may be positioned further away from the sealing lip of the lipseal. In certain embodiments, a portion of the contact ring assembly and/or the lipseal also include hydrophobic coatings.

26 Claims, 21 Drawing Sheets

U.S. PATENT DOCUMENTS

| | | | | |
|---|---|---|---|---|
| 6,124,203 | A | 9/2000 | Joo et al. | |
| 6,126,798 | A | 10/2000 | Reid et al. | |
| 6,139,712 | A | 10/2000 | Patton et al. | |
| 6,156,167 | A | 12/2000 | Patton et al. | |
| 6,159,354 | A | 12/2000 | Contolini et al. | |
| 6,162,344 | A | 12/2000 | Reid et al. | |
| 6,176,985 | B1 | 1/2001 | Downes, Jr. et al. | |
| 6,179,973 | B1 | 1/2001 | Lai et al. | |
| 6,179,983 | B1 | 1/2001 | Reid et al. | |
| 6,193,854 | B1 | 2/2001 | Lai et al. | |
| 6,217,716 | B1 | 4/2001 | Fai Lai | |
| 6,221,757 | B1 | 4/2001 | Schmidbauer et al. | |
| 6,251,238 | B1 | 6/2001 | Kaufman et al. | |
| 6,251,242 | B1 | 6/2001 | Fu et al. | |
| 6,261,433 | B1 | 7/2001 | Landau | |
| 6,267,860 | B1 | 7/2001 | Brodsky | |
| 6,270,646 | B1 | 8/2001 | Walton et al. | |
| 6,274,008 | B1 | 8/2001 | Gopalraja et al. | |
| 6,277,249 | B1 | 8/2001 | Gopalraja et al. | |
| 6,303,010 | B1 | 10/2001 | Woodruff et al. | |
| 6,413,388 | B1 | 7/2002 | Uzoh et al. | |
| 6,436,249 | B1 | 8/2002 | Patton et al. | |
| 6,517,689 | B1 | 2/2003 | Hongo et al. | |
| 6,540,899 | B2 | 4/2003 | Keigler | |
| 6,551,487 | B1 | 4/2003 | Reid et al. | |
| 6,579,430 | B2 * | 6/2003 | Davis et al. | 204/297.01 |
| 6,589,401 | B1 | 7/2003 | Patton et al. | |
| 6,612,915 | B1 * | 9/2003 | Uzoh et al. | 451/285 |
| 6,613,214 | B2 | 9/2003 | Dordi et al. | |
| 6,627,052 | B2 | 9/2003 | Fluegel et al. | |
| 6,755,946 | B1 | 6/2004 | Patton et al. | |
| 6,755,954 | B2 | 6/2004 | Mayer et al. | |
| 6,773,560 | B2 | 8/2004 | Pederson et al. | |
| 6,800,187 | B1 | 10/2004 | Reid et al. | |
| 6,869,510 | B2 | 3/2005 | Woodruff et al. | |
| 6,908,540 | B2 | 6/2005 | Kholodenko | |
| 7,033,465 | B1 | 4/2006 | Patton et al. | |
| 7,070,686 | B2 | 7/2006 | Contolini et al. | |
| 7,087,144 | B2 | 8/2006 | Herchen | |
| 7,522,055 | B2 | 4/2009 | Carrender et al. | |
| 7,935,231 | B2 * | 5/2011 | Ghongadi et al. | 204/297.1 |
| 7,985,325 | B2 * | 7/2011 | Rash et al. | 204/242 |
| 2002/0084183 | A1 | 7/2002 | Hanson et al. | |
| 2002/0108851 | A1 | 8/2002 | Woodruff et al. | |
| 2002/0144900 | A1 | 10/2002 | Keigler | |
| 2003/0010641 | A1 | 1/2003 | Kholodenko | |
| 2003/0085118 | A1 | 5/2003 | Tench et al. | |
| 2003/0085119 | A1 | 5/2003 | Davis et al. | |
| 2004/0084301 | A1 | 5/2004 | Dordi et al. | |
| 2004/0149573 | A1 | 8/2004 | Herchen | |
| 2006/0246690 | A1 * | 11/2006 | Dordi et al. | 438/478 |
| 2008/0117051 | A1 | 5/2008 | Carrender et al. | |
| 2009/0107835 | A1 | 4/2009 | Ghongadi et al. | |
| 2009/0107836 | A1 | 4/2009 | Rash et al. | |
| 2010/0155254 | A1 | 6/2010 | Prabhakar et al. | |
| 2011/0181000 | A1 | 7/2011 | Ghongadi et al. | |
| 2011/0233056 | A1 | 9/2011 | Rash et al. | |

FOREIGN PATENT DOCUMENTS

| | | |
|---|---|---|
| WO | WO 99/41434 | 8/1999 |
| WO | 03/006718 | 1/2003 |

OTHER PUBLICATIONS

U.S. Final Office Action mailed Oct. 7, 2003 for U.S. Appl. No. 09/927,741.
U.S. Office Action mailed Feb. 26, 2004 for U.S. Appl. No. 09/927,741.
U.S. Office Action mailed Oct. 8, 2003 for U.S. Appl. No. 10/010,954.
U.S. Notice of Allowance mailed Feb. 26, 2004 for U.S. Appl. No. 10/010,954.
U.S. Notice of Allowance mailed Jun. 1, 2004 for U.S. Appl. No. 09/927,741.
U.S. Notice of Allowance mailed Oct. 27, 2005 for U.S. Appl. No. 10/309,414.
Shin-Etsu Polymer Co., Ltd., "L-Type Connector," http://www.shinpoly.co.jp./business/connector/products__e/l.html?typezeb (1 page) downloaded May 23, 2003.
Shin-Etsu Polymer Co., Ltd., "SS-Type Connector," http://www.shinpoly.co.jp./ business/connector/products__e/ss.html?typezeb (2 pages) downloaded May 23, 2003.
Shantinath Ghongadi et al., Rapidly Cleanable Electroplating Cup Assembly, U.S. Appl. No. 11/932,595, filed Oct. 31, 2007.
U.S. Office Action for U.S. Appl. No. 11/932,595 mailed Jul. 7, 2010.
U.S. Final Office Action for U.S. Appl. No. 11/932,595 mailed Nov. 17, 2010.
U.S. Notice of Allowance for U.S. Appl. No. 11/932,595 mailed Jan. 26, 2011.
U.S. Appl. No. 11/929,632, Office Action mailed Jun. 25, 2008.
U.S. Appl. No. 11/929,632, Notice of Allowance mailed Dec. 15, 2008.
U.S. Appl. No. 11/929,638, Office Action mailed Mar. 2, 2011.
U.S. Appl. No. 11/929,638, Notice of Allowance mailed May 23, 2011.
U.S. Appl. No. 11/932,595, Notice of Allowance mailed Mar. 8, 2011.
U.S. Appl. No. 11/932,595, Notice of Allowance mailed Mar. 11, 2011.
U.S. Appl. No. 11/932,595, Notice of Allowance mailed Mar. 18, 2011.
Shin-Etsu Polymer Co., Ltd., "L-Type Connector", http://www.shinpoly.co.jp/business/connector/products__e/l.html?typezeb downloaded Feb. 16, 2011.
Shin-Etsu Polymer Co., Ltd., "SS-Type Connector", http://www.shinpoly.co.jp/business/connector/products__e/ss.homl?typezeb downloaded Feb. 16, 2011.
U.S. Appl. No. 13/079,745, "Rapidly cleanable electroplating cup seal", filed Apr. 4, 2011.
U.S. Appl. No. 13/154,224, "Electroplating cup assembly", filed Jun. 11, 2011.
SG patent application No. 200908245.4, Written Opinion dated Mar. 9, 2011.
U.S. Appl. No. 13/154,224, Office Action mailed Nov. 4, 2011.

* cited by examiner 308
304
306
508
220
212
212(b)
502
216

Opening
504
220
212(b)
502

208
506
504
502
220

Replacement Sheet

Open

Change to More Hydrophobic Coating

Open

WAFER ELECTROPLATING APPARATUS FOR REDUCING EDGE DEFECTS

CROSS-REFERENCE TO RELATED APPLICATIONS

This application claims the benefit under 35 U.S.C. §119 (e) of U.S. Ser. No. 61/121,460, entitled: "WAFER ELECTROPLATING APPARATUS FOR REDUCING EDGE DEFECTS", filed Dec. 10, 2008, which is incorporated herein in its entirety.

BACKGROUND

Electroplating, electroless plating, electropolishing, or other wet chemical deposition or removal processes employed in semiconductor device fabrication may be performed in "clamshell" apparatuses. The two main components of a clamshell, such as Novellus Systems' Sabre® tool, are a "cup" and a "cone" that form an assembly. Generally, the cup and cone assembly holds, positions, and often rotates a wafer during processing. A lipseal on the lip of the cup may contain embedded contacts for delivering plating current to a seed layer on a wafer. The clamshell provides edge and backside protection to the wafer. In other words, electrolyte is prevented from contacting an edge and backside of a wafer when it is immersed during a plating process. Edge and backside protection is afforded by fluid-resistant seals that are formed when the cup and cone engage one another to hold a wafer.

A plating solution typically includes metal ions in acidic or basic aqueous media. For example, electrolyte may include copper sulfate dissolved in dilute sulfuric acid. During processing, electrical contacts, which deliver plating and/or polishing currents to the wafer and are generally intended to be kept dry by the cup/cone/lipseal hardware combination, can become contaminated with electrolyte and their performance degraded after multiple plated wafer cycles. Electrolyte in the contact area can also be damaging to the wafer, for example, causing particle contamination on the wafer edge.

New apparatuses and methods are needed to reduce plating solution contamination of sensitive clamshell components.

SUMMARY

A base plate with a hydrophobic coating covering at least a portion of the plate exposed to electrolyte is used to minimize rinsate and electrolyte wicking into the contact area of the clamshell. Less wicking helps to reduce wafer defects, in particular edge effects, and reduce maintenance frequency. In some implementations, a hydrophobic coating includes polyamide-imide (PAI) and, in certain embodiments, also includes polytetrafluoroethylene (PTFE). It has been found that defect rates are more than 80% lower for the inventive base plate compared with conventional base plates when used with new lipseals and continue being lower as lipseals age.

In certain embodiments, a base plate is used in a cup configured to hold a semiconductor wafer during electroplating and to exclude electroplating solution from reaching electrical contacts. The base plate may include a ring-shaped body and a knife-shaped protrusion extending inward from the ring-shaped body and configured to support an elastomeric lipseal. The elastomeric seal can engage the semiconductor wafer and exclude the electroplating solution from reaching the electrical contacts.

The base plate may also include a hydrophobic coating covering at least the knife-shaped protrusion. The coating may include polyamide-imide (PAI), polyvinylidene fluoride (PVDF), polytetrafluoroethylene (PTFE), and/or copolymers thereof. In particular embodiments, the hydrophobic coating includes polyamide-imide (PAI). Even in more particular embodiments, the coating also includes polytetrafluoroethylene (PTFE). The coating may be applied using a spray coating technique. For example, at least one layer of Xylan P-92 onto at least the knife-shaped protrusion. Further, one layer of Xylan 1010 may be sprayed over the layer of Xylan P-92. The thickness of the coating may be between about 20 μm and 35 μm. In certain embodiments, the coating can pass a 90V spark test. The coating may not leach or absorb a detectable amount of the electrolyte solution.

In certain embodiments, the ring-shaped body and the knife shaped protrusion comprise one or more materials selected from the group consisting of stainless steel, titanium, and tantalum. The ring-shaped body may be configured to removably attach to a shield structure of an electroplating apparatus. The ring-shaped body may include a groove configured to engage with a ridge on a lipseal. The knife-shaped protrusion may be configured to support at least about 200 pounds of force. Further, the base plate may be configured for use in a Novellus Sabre® electroplating system.

In certain embodiments, a contact ring that can be used in a cup includes a unitary ring-shaped body sized and shaped to engage other components of the cup and contact fingers attached to and extending inwardly from the unitary ring-shaped body. The contact fingers can be angularly disposed apart from one another. Each contact finger can be oriented to contact the semiconductor wafer at a point less than about 1 mm from an outer edge of the wafer. The ring-shaped body and the plurality of contact fingers may be made from Paliney 7. The contact fingers can have a generally V-shape extending downwardly from a plane defined by the unitary ring-shaped body and then pointing upward to a distal point for contacting the semiconductor wafer. There may be at least about 300 contact fingers. The contact fingers may be configured to bend under a force exerted by the semiconductor wafer during electroplating. At least a part of each finger may be coated with one or more of polytetrafluroethlyene (PTFE), ethylene-tetrafluoroethylene (ETFE), polyvinylidene fluoride (PVDF), and copolymers thereof.

In certain embodiments, a lipseal and contact ring assembly may be used in a cup and include a ring-shaped elastomeric lipseal for engaging the semiconductor wafer and excluding the plating solution a peripheral region of the semiconductor wafer and the contact ring. The ring-shaped elastomeric lipseal has an inner diameter defining a perimeter for excluding the plating solution from the peripheral region of the semiconductor wafer during electroplating.

The contact ring has a unitary ring-shaped body and a plurality of contact fingers attached to and extending inwardly from the ring-shaped body and angularly disposed apart from one another. Each contact finger may be oriented to engage the semiconductor wafer at a point at least about 1 mm from the lipseal inner diameter. In certain embodiments, the contact fingers each has have a generally V-shape extending downwardly from a plane defined by the unitary ring-shaped body and then pointing upward to a distal point above a plane where the ring-shaped elastomeric lipseal engaging the semiconductor wafer. The ring-shaped elastomeric lipseal may have a hydrophobic coating. Further, the ring-shaped elastomeric lipseal may have a groove for accommodating a distribution bus. A portion of the ring-shaped elastomeric lipseal engaging the semiconductor wafer may compress during the engagement.

In certain embodiments, an electroplating apparatus is configured to hold a semiconductor wafer during electroplating and to exclude plating solution from contacting certain parts of the electroplating apparatus. The apparatus may include a cup for supporting the semiconductor wafer including a base plate with a ring-shaped body and a knife-shaped protrusion extending inward from the ring-shaped body, a cone for exerting force on the semiconductor wafer and pressing the semiconductor wafer against an elastomeric seal, and a shaft. The base plate is configured to support the elastomeric lipseal for engaging the semiconductor wafer and excluding the electroplating solution from reaching the electrical contacts. The base plate may have a hydrophobic coating covering at least the knife-shaped protrusion. The shaft may be configured to move the cone relative to the cup and to exert a force on the semiconductor wafer through the cone in order to seal the semiconductor wafer against the elastomeric seal of the cup and to rotate the cup and the cone.

In certain embodiments, the apparatus also includes a controller with instructions for positioning the semiconductor wafer on the cup, lowering the cone onto the semiconductor wafer to exert a force on the back side of the semiconductor wafer in order to establish a seal between a lipseal of the cup and the front surface of the wafer, submerging at least a portion of the front surface of the wafer into an electroplating solution and electroplating on the front surface of the wafer, and lifting the cone to release the force from the back side of the semiconductor wafer, wherein lifting is performed over a period of at least 2 seconds.

In certain embodiments, a method for electroplating a semiconductor wafer in an apparatus containing a cup and a cone includes positioning the semiconductor wafer on the cup, lowering the cone onto the semiconductor wafer to exert a force on the back side of the semiconductor wafer in order to establish a seal between a lipseal of the cup and the front surface of the wafer, submerging at least a portion of the front surface of the wafer into an electroplating solution and electroplating on the front surface of the wafer, and lifting the cone to release the force from the back side of the semiconductor wafer, wherein lifting is performed over a period of at least 2 seconds. The method may also include rotating the semiconductor wafer for at least about 3 seconds prior to lifting the cone.

DETAILED DESCRIPTION OF EXAMPLE EMBODIMENTS

Figure 1:
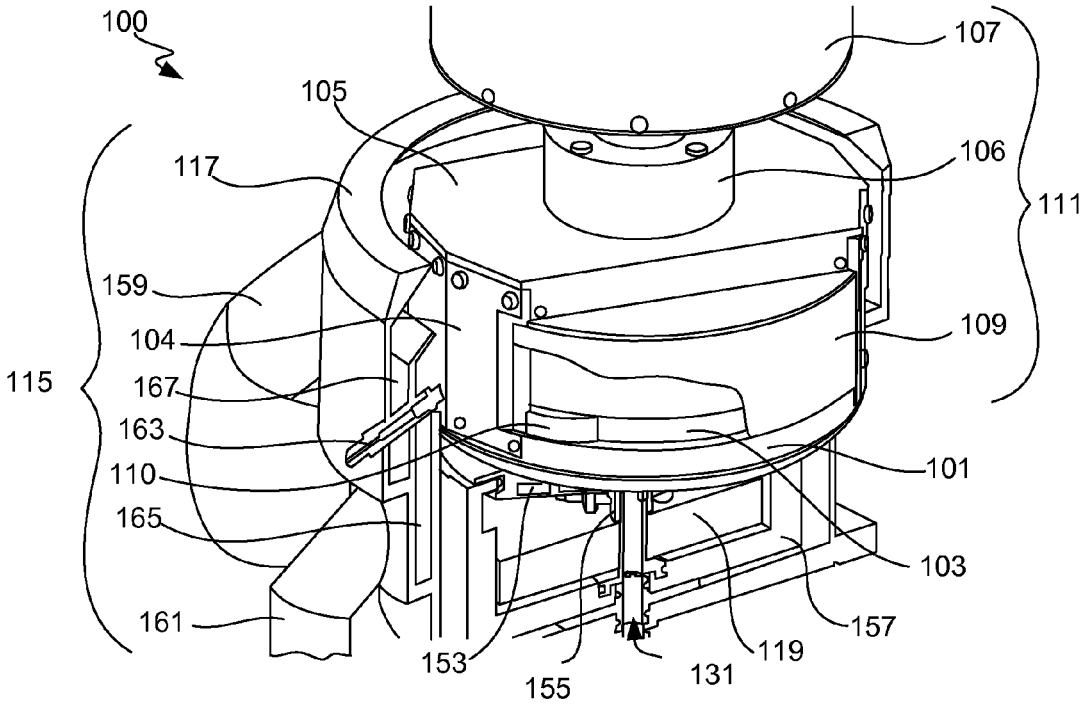
FIG. 1 is a perspective view of a wafer holder assembly for electrochemically treating semiconductor wafers in accordance with an embodiment of this invention.

In the following description, numerous details are set forth in order to provide a thorough understanding of the present invention. The present invention may be practiced without some or all of these details. In other instances, well known process operations have not been described in detail to not unnecessarily obscure the present invention. While the invention will be described in conjunction with the specific embodiments, it will be understood that it is not intended to limit the invention to the embodiments.

Introduction

Electroplating and other processes using a clamshell usually involve submerging at least a bottom portion of the clamshell into the electroplating solution. After plating is completed, the plated wafer is typically spun to remove most of the entrained concentrated electrolyte and rinsed with deionized water or another rinsing liquid. The clamshell may be then spun again to remove residual rinsate (i.e., an electroplating solution diluted in a rinsing liquid). However, some rinsate may accumulate and remain around the lipseal. The lipseal is used to prevent any liquid from getting into the contacts area of the sealed clamshell when the clamshell is closed. When the seal is broken during opening of the clamshell, some rinsate may migrate into the contact area driven by the surface tension. Relatively hydrophilic copper surfaces of the wafer's front side and the contacts stimulate this migration leading to substantial rinsate amounts wicking into the contacts area. There, the rinsate may form particle, destroy the contact, and generally lead to various edge related plating defects.

The "wicked volume" is a measure of the rinsate amount (e.g., volume, weight, etc.) extracted from the contact area after a typical electroplating cycle. Different measuring techniques may be used to determine the wicked volume. One technique involves using a Kimwipe (e.g., Kimetch Science Wipes, White Single Ply 4.5"×8.5" supplied by Kimberley-Clark) or other similar highly absorbent cloth to wipe the entire contact area of the clamshell. Such cloth is weighed before and after wiping and the weight gain is treated as a "wicked volume". Another technique uses a controlled amount of solvent to dilute the rinsate in the contact area. The resulting solution is then sampled and analyzed (e.g., measuring conductivity of the sample, analyzing its composition using mass spectroscopy, or any other suitable analytic techniques) to determine the rinsate amount in the sample and, as a result, in the contact area.

The wicked volume has been found to correlate with the number of defects located proximate the wafer edge, e.g., the number of defects located in the outermost 10 mm of the wafer. This area is particularly important in semiconductor manufacturing because of the large edge die population close to the edge. Certain embodiments of the present invention led to a substantial (sometimes tenfold) reduction in the number of wafer edge defects.

Some embodiments described in this document are specific to individual parts of the clamshell apparatus, such as a cup bottom, an electrical contact, and a lipseal. These parts may be supplied together as an integrated part of a clamshell plating apparatus or they may be supplied as separate components used to replace broken or worn parts in deployed systems, or to retrofit such systems. In some cases, a part or parts of the clamshell apparatus may be replaced during routine maintenance.

Apparatus

FIG. 1 presents a perspective view of a wafer holding and positioning apparatus 100 for electrochemically treating semiconductor wafers. The apparatus 100 includes wafer-engaging components, which are sometimes referred to as "clamshell" components, a "clamshell" assembly, or a "clamshell.". The clamshell assembly comprises a cup 101 and a cone 103. As will be shown in subsequent figures, the cup 101 holds a wafer and the cone 103 clamps the wafer securely in the cup. Other cup and cone designs beyond those specifically depicted here can be used. A common feature is a cup that has an interior region in which the wafer resides and a cone that presses the wafer against the cup to hold it in place.

In the depicted embodiment, the clamshell assembly (the cup 101 and the cone 103) is supported by struts 104, which are connected to a top plate 105. This assembly (101, 103, 104, and 105) is driven by a motor 107 via a spindle 106 connected to the top plate 105. The motor 107 is attached to a mounting bracket (not shown). The spindle 106 transmits torque (from the motor 107) to the clamshell assembly causing rotation of a wafer (not shown in this figure) held therein during plating. An air cylinder (not shown) within the spindle 106 also provides a vertical force for engaging the cup 101 with the cone 103. When the clamshell is disengaged (not shown), a robot with an end effector arm can insert a wafer in between the cup 101 and the cone 103. After a wafer is inserted, the cone 103 is engaged with the cup 101, which immobilizes the wafer within apparatus 100 leaving only the wafer front side (work surface) exposed to electrolyte.

In certain embodiments, the clamshell includes a spray skirt 109 that protects the cone 103 from splashing electrolyte. In the depicted embodiment, the spray skirt 109 includes a vertical circumferential sleeve and a circular cap portion. A spacing member 110 maintains separation between the spray skirt 109 and the cone 103.

For the purposes of this discussion, the assembly including components 101-110 is collectively referred to as a "wafer holder" 111. Note however, that the concept of a "wafer holder" extends generally to various combinations and subcombinations of components that engage a wafer and allow its movement and positioning.

A tilting assembly (not shown) may be connected to the wafer holder to permit angled immersion (as opposed to flat horizontal immersion) of the wafer into a plating solution. A drive mechanism and arrangement of plates and pivot joints are used in some embodiments to move wafer the holder 111 along an arced path (not shown) and, as a result, tilt the proximal end of wafer holder 111 (i.e., the cup and cone assembly).

Further, the entire wafer holder 111 is lifted vertically either up or down to immerse the proximal end of wafer holder into a plating solution via an actuator (not shown). Thus, a two-component positioning mechanism provides both vertical movement along a trajectory perpendicular to an electrolyte surface and a tilting movement allowing deviation from a horizontal orientation (i.e., parallel to the electrolyte surface) for the wafer (angled-wafer immersion capability).

Note that the wafer holder 111 is used with a plating cell 115 having a plating chamber 117 which houses an anode chamber 157 and a plating solution. The chamber 157 holds an anode 119 (e.g., a copper anode) and may include membranes or other separators designed to maintain different electrolyte chemistries in the anode compartment and a cathode compartment. In the depicted embodiment, a diffuser 153 is employed for directing electrolyte upward toward the rotating wafer in a uniform front. In certain embodiments, the flow diffuser is a high resistance virtual anode (HRVA) plate, which is made of a solid piece of insulating material (e.g. plastic), having a large number (e.g. 4,000-15,000) of one dimensional small holes (0.01 to 005 inch in diameter) and connected to the cathode chamber above the plate. The total cross-section area of the holes is less than about 5 percent of the total projected area, and, therefore, introduces substantial flow resistance in the plating cell helping to improve the plating uniformity of the system. Additional description of a high resistance virtual anode plate and a corresponding apparatus for electrochemically treating semiconductor wafers is provided in U.S. application Ser. No. 12/291,356 filed on Nov. 7, 2008, incorporated herein, in its entirety, by reference. The plating cell may also include a separate membrane for controlling and creating separate electrolyte flow patterns. In another embodiment, a membrane is employed to define an anode chamber, which contains electrolyte that is substantially free of suppressors, accelerators, or other organic plating additives.

The plating cell may also include plumbing or plumbing contacts for circulating electrolyte through the plating cell—and against the work piece being plated. For example, the cell 115 includes an electrolyte inlet tube 131 that extends vertically into the center of anode chamber 157 through a hole in the center of anode 119. In other embodiments, the cell includes an electrolyte inlet manifold that introduces fluid into the cathode chamber below the diffuser/HRVA plate at the peripheral wall of the chamber (not shown). In some cases, the inlet tube 131 includes outlet nozzles on both sides (the anode side and the cathode side) of the membrane 153. This arrangement delivers electrolyte to both the anode chamber and the cathode chamber. In other embodiments, the anode and cathode chamber are separated by a flow resistant membrane 153, and each chamber has a separate flow cycle of separated electrolyte. As shown in the embodiment of FIG. 1, an inlet nozzle 155 provides electrolyte to the anode-side of membrane 153.

In addition, plating cell 115 includes a rinse drain line 159 and a plating solution return line 161, each connected directly to the plating chamber 117. Also a rinse nozzle 163 delivers deionized rinse water to clean the wafer and/or cup during normal operation. Plating solution normally fills much of the chamber 117. To mitigate splashing and generation of bubbles, the chamber 117 includes an inner weir 165 for plating solution return and an outer weir 167 for rinse water return. In the depicted embodiment, these weirs are circumferential vertical slots in the wall of the plating chamber 117.

Figure 2A:
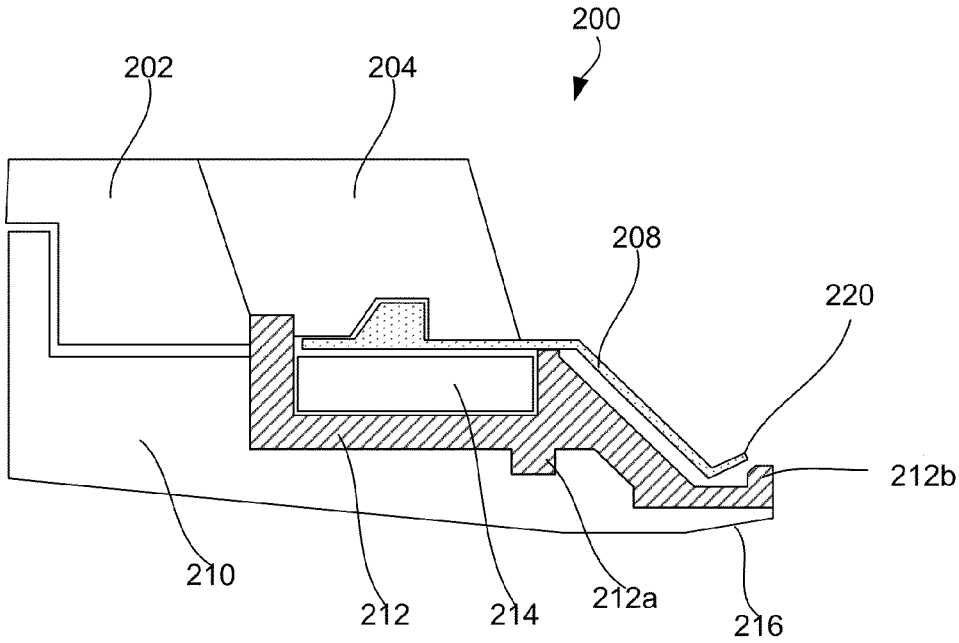
FIG. 2A illustrates a cut-out view of clamshell components used to establish an electrical connection with a wafer and to seal the wafer from plating solution contained in the electrolyte bath.

The following description presents additional features and examples of cup assemblies that may be employed in certain embodiments. Certain aspects of the depicted cup designs provide for greater edge plating uniformity and reduced edge defects due to improved edge flow characteristics of residual electrolyte/rinsate, controlled wafer entry wetting, and lipseal bubble removal. FIG. 2A is an illustrative cut-out view of a cup assembly 200. The assembly 200 includes a lipseal 212 for protecting certain parts of the cup from electrolyte. It also includes a contact element 208 for establishing electrical connection with conductive elements of the wafer. The cup and its components may have an annular shape and be sized to engage wafer's periphery (e.g., a 200-mm wafer, a 300-mm wafer, a 450-mm wafer).

The cup assembly includes a cup bottom 210, which is also referred to as a "disk" or a "base plate" and which may be attached to a shield structure 202 with a set of screws or other fastening means. The cup bottom 210 may be removed (i.e., detached from the shield structure 202) to allow replacing various components of the cup assembly 200, such as a seal 212, a current distribution bus 214 (a curved electrical bus bar), an electrical contact member strip 208, and/or the cup bottom 210 itself. A portion (generally, the outermost portion) of the contact strip 208 may be in contact with a continuous metal strip 204. The cup bottom 210 may have a tapered edge 216 at its innermost periphery, which is shaped in such ways as to improve flow characteristic of electrolyte/rinsate around the edge and improve bubble rejection characteristics. The cup bottom 210 may be made of a stiff, corrosive resistant material, such as stainless steel, titanium, and tantalum. During closing, the cup bottom 210 supports the lipseal 212 when the force is exerted through the wafer to avoid clamshell leakage during wafer immersion as further described in the context of FIGS. 3A and 3B. In certain embodiments, the force exerted on the lipseal 212 and the cup bottom 210 is at least about 200 pounds force. The closing force, which is also referred to as closing pressure, is exerted by the clamshell "cone" assembly, the portion of which that makes contact to the wafer backside.

Figure 2B:
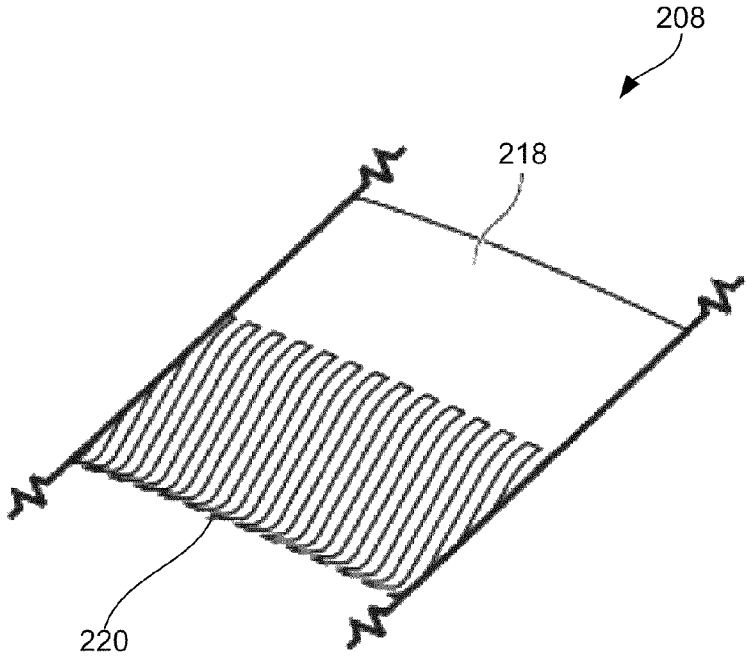
FIG. 2B is a perspective view of a portion of a contact member in accordance with certain embodiments.

An electrical contact member 208 provides electrical contact conductive materials deposited on the front side of the wafer. As shown in FIGS. 2A and 2B, a contact member 208 includes a large number of individual contact fingers 220 attached to a continuous metal strip 218. In certain embodiments, the contact member 208 is made out of Paliney 7 alloy. However, other suitable materials can be used. In certain embodiments corresponding to 300-mm wafer configurations, the contact member 208 has at least about 300 individual contact fingers 220 evenly spaced around the entire perimeter defined by the wafer. The fingers 220 may be created by cutting (e.g., laser cutting), machining, stamping, precision folding/bending, or any other suitable methods. The contact member 208 may form a continuous ring, wherein the metal strip 218 defines the outer diameter of the ring, and the free tips of the finger 220 define the inner diameter. It should be noted these diameters will vary depending on the cross-sectional profile of the contact member 208, as for example shown in FIG. 2A. Further, it should be noted that the fingers 220 are flexible and may be pushed down (i.e., towards the tapered edge 216) when the wafer is loaded. For example, the fingers 220 move from a free position to a different intermediate position when a wafer is placed into the clamshell to yet another different position when the cone exerts pressure onto the wafer. During operation, the lip 212*b* of the elastic lipseal 212 resides near the tips of the fingers 220. For example, in their free position the fingers 220 may extend higher than the lip 212*b*. In certain embodiments, the fingers 220 extend higher than the lip 212*b* even in their intermediate position when the wafer is places into the cup 200. In other words, the wafer is supported by the tips of the fingers 220 and not the lip 212*b*. In other embodiments, the fingers 220 and/or the lip 212*b* seal bend or compress when the wafer is introduced into the cup 2000 and both the tips 220 and the lip 212*b* are in the contact with the wafer. For example, the lip 212*b* may initially extend higher than the tips and then be compressed and the fingers 220 deflected and compressed to form contact with the wafer. Therefore, to avoid ambiguity the dimensions described herein for the contact member 208 are provided when a seal is established between the wafer and the lipseal 212.

Returning to FIG. 2A, the seal 212 is shown to include a lipseal capture ridge 212*a* configured to engage with a groove in the cup bottom 210 and thereby hold the seal 212 in a desired location. A combination of the ridge and the groove may help positioning the seal 212 in a correct location during installation and replacement of the seal 212 and also may help to resist displacement of the seal 212 during normal use and cleaning. Other suitable keying (engagement) features may be used.

The seal 212 further comprises feature, such as a groove formed in its upper surface that is configured to accommodate the distribution bus bar 214. The distribution bus bar 214 is typically composed of a corrosion resistant material (e.g., stainless steel grade 316) and is seated within the groove. In some embodiments, the seal 212 may be bonded (e.g., using an adhesive) to the distribution bus 214 for additional robustness. In the same or other embodiments, the contact member 208 is connected to the distribution bus 214 around the continuous metal strip 218. Generally, the distribution bus 214 is much thicker than the continuous metal strip 218 and can therefore provide for more uniform current distribution by enabling a minimal Ohmic voltage drop between the location where the bus bar makes contact with the power lead (not shown) and any azimuthal location where current exits through the strip 218 and the fingers 220 into the wafer.

Figure 3A:
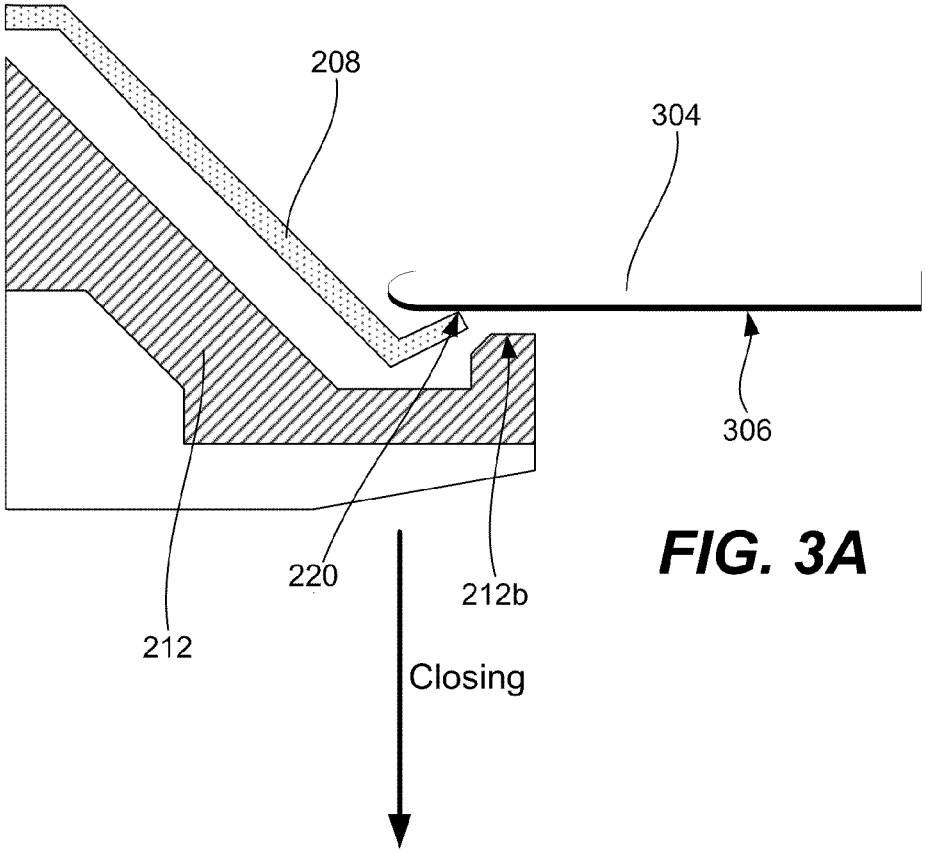
FIG. 3A illustrates a part of the clamshell and a wafer before closing the clamshell and establishing a seal between the wafer and the clam shell in accordance with certain embodiments.

FIG. 3A illustrates a part of the clamshell and a wafer 304 before closing the clamshell and establishing a seal between the wafer 304 and the lipseal 212. In some embodiments, the wafer 304 may first touch the contact member 208, more specifically the contact tips 220. Alternatively, the wafer 304 may first come in the contact with the sealing edge 212*b* of the seal 212. Generally, the contact tip 302 comes in the contact with the front side (active surface) 306 of the wafer 304 before the wafer 304 goes down into the final position that it maintains during the electroplating. In other words, the contact tips 220 experiences some deflection during clamshell closing, which results in some force between the front side 306 and the tips 220 that helps the electrical contact between the two. It should be noted defection may happen either when the front surface 306 first contacts the tips 220 or when it first contacts the lip 212*b*. The front side 306 normally contains some conductive material, such as copper, ruthenium, or copper over ruthenium that may be in a form of a seed layer or other forms. The degree of deflection (or force between the tips and the front side) may be adjusted to provide adequate conductivity between the material on the front surface and the tips.

Figure 3B:
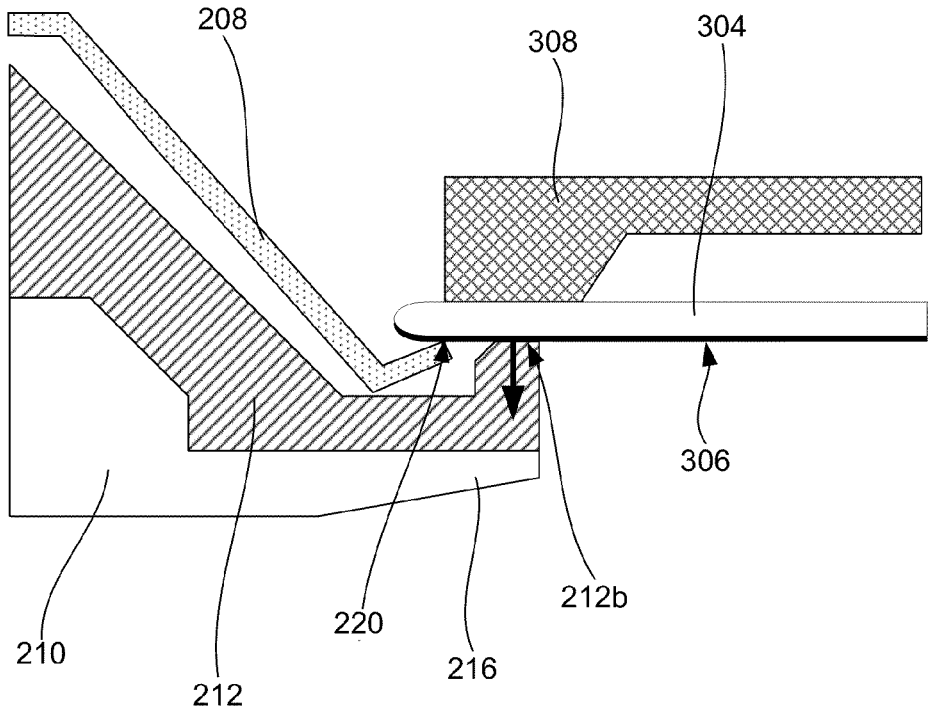
FIG. 3B illustrates a part of the clamshell and a wafer after closing the clamshell and establishing a seal between the wafer and the clam shell in accordance with certain embodiments.

FIG. 3B illustrates a part of the clamshell and the wafer 304 after closing the clamshell and establishing a seal between the wafer 304 and the clamshell of more specifically between the wafer 304 and the lipseal 212. The closing operation involves lowering a cup 308 and pressing with the cup 308 onto the back side of the wafer 304. As a result of this pressure, the active surface 306 comes into the contact with the lip 212*b* of the lipseal 212 and the sealing lip 212 and the region of the lipseal 212 below the contact point may experience some compression. The compression also ensures that the entire perimeter of the lip 212*b* is in the contact with front surface 306, especially if there are some imperfections in surfaces of either one. A lipseal 212 is typically made out of compressible materials.

A clamshell assembly shown in FIG. 3B may be used on a Sabre® electroplating system supplied by Novellus Systems, Inc. in San Jose, Calif. Implementation of the novel clamshell assembly improves sealing and reduces minimal wafer-edge entrapped-bubble related defects. It is also permits easy manual cleaning and as well as automatic cleaning rinsing and cleaning/etching operations (known as cup contact rinse, CCR and automatic contact etch, ACE operations). Recently, a specific problem of "solid particle defects" was identified. Without being restricted to any particular theoretical principle or mechanism, it is believed that the transfer of the edge entrained fluid from the wafer/lip-seal edge area into the clamshell cup contact area can lead to the formation of particles (e.g., drying out, crystallization, reacting with clamshell components), which eventually cause solid particle edge defects.

Figure 4:
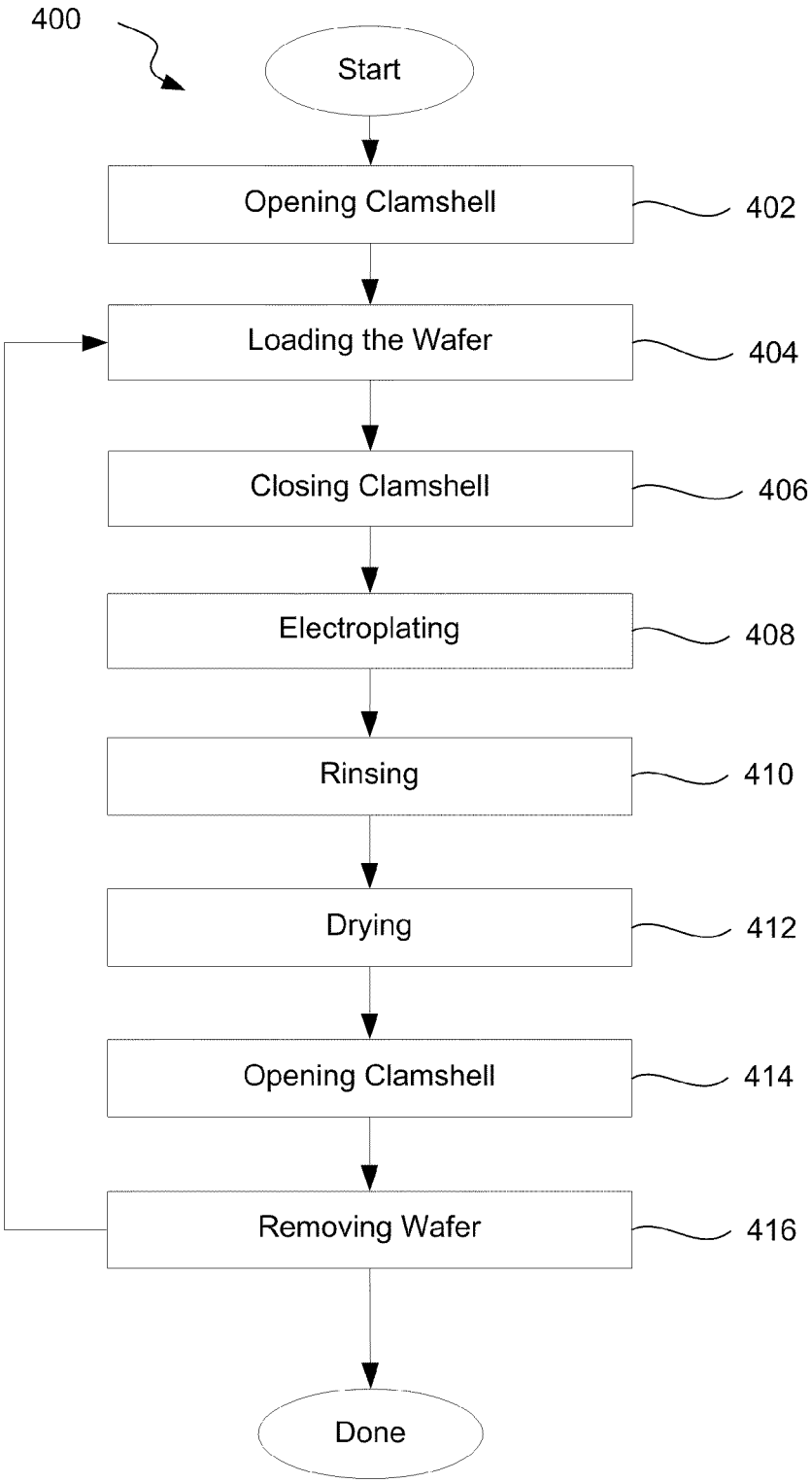
FIG. 4 is an illustrative flowchart of the electroplating process in accordance with certain embodiments.

FIG. 4 is an illustrative flowchart of the electroplating process in accordance with certain embodiments. Initially, the lipseal and contact area of the clamshell may be clean and dry. The clamshell is opened (block 402) and the wafer is loaded into the clamshell. In certain embodiments, the contact tips sit slightly above the plane of the sealing lip and the wafer is supported, in this case, by the array of contact tips around the wafer periphery as shown in FIG. 3A. The clamshell is then closed and sealed by moving the cone 308 downward (block 406). During this closure operation, the contacts are typically deflected. Further, the bottom corners of the contacts may be force down against the elastic lipseal base, which results in additional force between the tips and the front side of the wafer. The sealing lip may be slightly compressed to ensure the seal around the entire perimeter. In some embodiments, when the wafer is initially positioned into the cup only the sealing lip is contact with the front surface. In this example, the electrical contact between the tips and the front surface is established during compression of the sealing lip.

One the seal and the electrical contact is established in operation 406, the clamshell carrying the wafer is immersed into the plating bath and is plated in the bath while being held in the clamshell (block 408). A typical composition of a copper plating solution used in this operation includes copper ions at a concentration range of about 0.5-80 g/L, more specifically at about 5-60 g/L, and even more specifically at about 18-55 g/L and sulfuric acid at a concentration of about 0.1-400 g/L. Low-acid copper plating solutions typically contain about 5-10 g/L of sulfuric acid. Medium and high-acid solutions contain about 50-90 g/L and 150-180 g/L sulfuric acid respectively. The concentration of chloride ions may be about 1-100 mg/L. A number of copper plating organic additives, such as Enthone Viaform, Viaform NexT, Viaform Extreme (available from Enthone Corporation in West Haven, Conn.), or other accelerators, suppressors and levelers known to those of skill in the art, can be used. Examples of plating operations are described in more details in U.S. patent application Ser. No. 11/564,222 filed on Nov. 28, 2006, which is incorporated herein in its entirety for the purpose of the describing plating operations. Once the plating is completed and appropriate amount of material is deposited on the front surface of the wafer, the wafer is then removed from the plating bath. The wafer and clamshell are spun to remove most of the residual electrolyte on the clamshell surfaces remaining there due to the surface tensions. The clamshell is then rinsed while continued to be spun to dilute and flush as much of the entrained fluid as possible from clamshell and wafer surfaces (block 410). The wafer is then spun with rinsing liquid turned off for some time, usually at least about 2 seconds to remove some remaining rinsate (block 412).

Figures 5A, 5B, 5C:
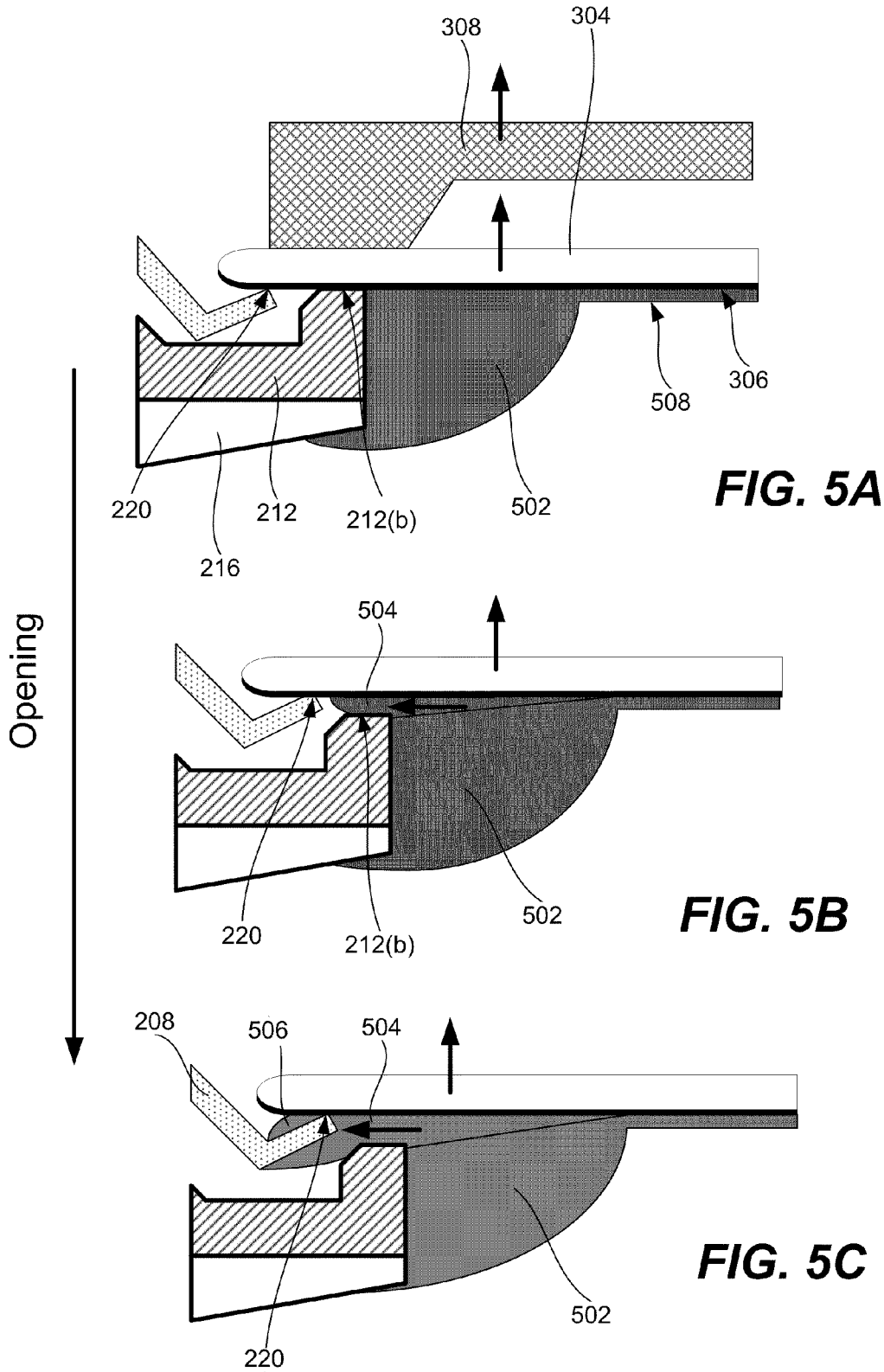
FIGS. 5A-C illustrate examples of different stages and relative positions of the clamshell components and electrolyte residue during the clamshell opening operation.

However, some rinsate 502 remains on the wafer's front side 306 and clamshell (the lipseal 212 and the tapered edge 216) surfaces 508 as, for example, shown in FIG. 5A. Rinsate is held by surface tension forces which may exceed forces created by spinning the clamshell. Even after prolonged spinning of the clamshell some rinsate may remain in the corner where the sealed between the front surface 306 of the wafer and the sealing lip 212(*b*) is established. Generally, a period of time that is allowed for spinning and drying is limited by the overall process throughput.

FIGS. 5A-C illustrate different stages and relative positions of the clamshell components and rinsate residue 502 during the clamshell opening operation 404. The rinsate residue 502 forms a "wicked" bead near the interface of the front surface 306 and the lipseal 212 as a result of centrifuge forces from clamshell spinning and surface tension forces. Rinsate accumulation at this interface is highly undesirable as it leads to some rinsate getting into the contact area. During opening the clamshell closing cone 308 is retracted, which removes downward forces applied to the wafer 304 and the seal edge 212(*b*) in order to extract the processed wafer 304 from the clamshell assembly. This dynamic process creates a number of interrelated causes and effects. As the cone 308 moves upwards, a slight pressure differential may be created (i.e., higher pressure on the front side 306 of the wafer (effectively pushing the wafer 306 off of the lip 212(*b*) and the contact tips 220. Further, the energy stored in a compressed lip 212(*b*) may be released and the wafer 306 may spring upwards off of the lip 212(*b*) and the contact tips 220. The contacts 208, which are deflected and exert an upward force on the wafer periphery, may move the wafer 304 upwards and create a gap between the sealing lip 212(*b*) and the front side 306 of the wafer 304 as shown in FIGS. 5B-5C. The wafer 304 may also be lifted from its original position during plating with certain wafer handling equipment, which is used, for example, to remove wafers from clamshell assemblies. In either case, at some point during the clamshell opening operation 404 the seal between the sealing lip 212(*b*) and the front side 306 of the wafer 304 is broken and a gap between these two elements is created.

The upward movement of the wafer 304 coupled with a change in shape of the sealing lip 212(*b*) (from compressed to uncompressed) is believed to create a pumping like action that draws some rinsate 504 into the gap between the front side 306 and the sealing lip 212(*b*) as shown in FIG. 5B. In addition to pressure differential on each side of the seal that is described above and/or shape changes of the sealing lip 212 (*b*), surface tension may draw fluid by, for example, exposing more of the wafer front side 306 that was previously sealed off.

As the rinsate propagates through the gap, it may come into the contact area and wet the contact tips 220 as shown in FIG. 5C. The contacts are typically made of highly hydrophilic (and mater is the main component of the rinsate) materials, such as Paliney 7, which may have been subsequently coated with hydrophilic plated copper. As a result more, rinsate is drawn through the gap by these new surface tension forces and a small rinsate pool 506 may form around contacts. This rinsate pool 506 may later redistribute in the contact area and dry out forming solid particles resulting from electrolyte residues in the rinsate. While each rinsate pool 506 added into the contact area during the opening operation 414 may be small, the opening operating is repeated for each new wafer resulting in substantial build ups of rinsate and resulting particles in the contact area.

Returning to FIG. 4, the clamshell is now open and the wafer is removed from the clamshell (block 416). Operations 404 through 416 may be repeated multiple times for new wafers. The contact region, therefore, may continuously collect additional rinsate with each new plating cycle. The rinsate collected in the contacts region may dry over time resulting in precipitation of dissolved metal salts and crystal buildups.

Figure 6A:
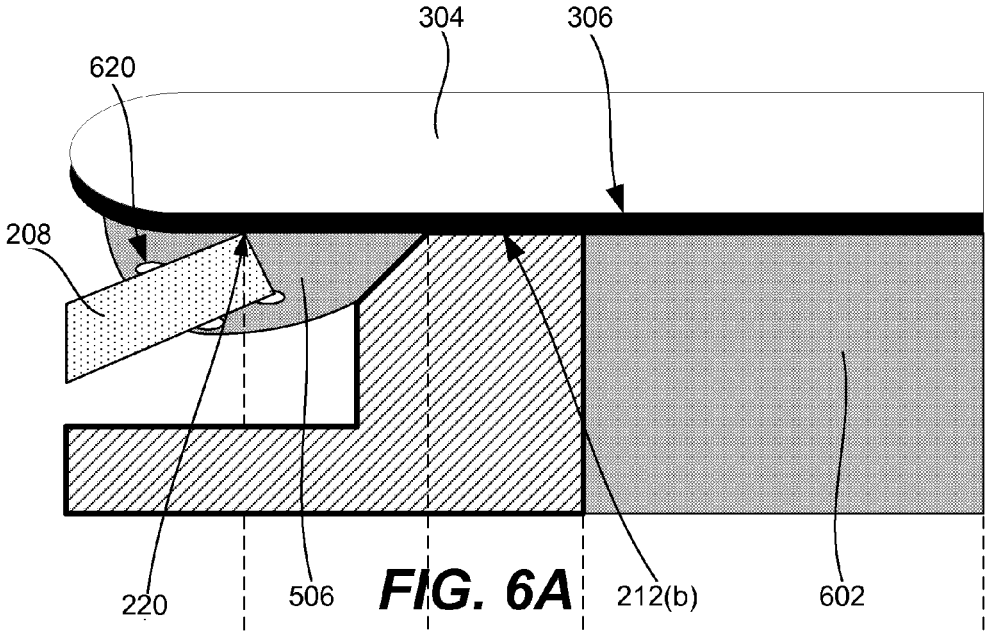
FIGS. 6A-B illustrate a part of the clamshell during the electroplating operation where some rinsate residue has contaminated the contact area and a corresponding plot of the voltage in the different components and positions of the clamshell during electroplating process in accordance with certain embodiments.
Figure 6B:
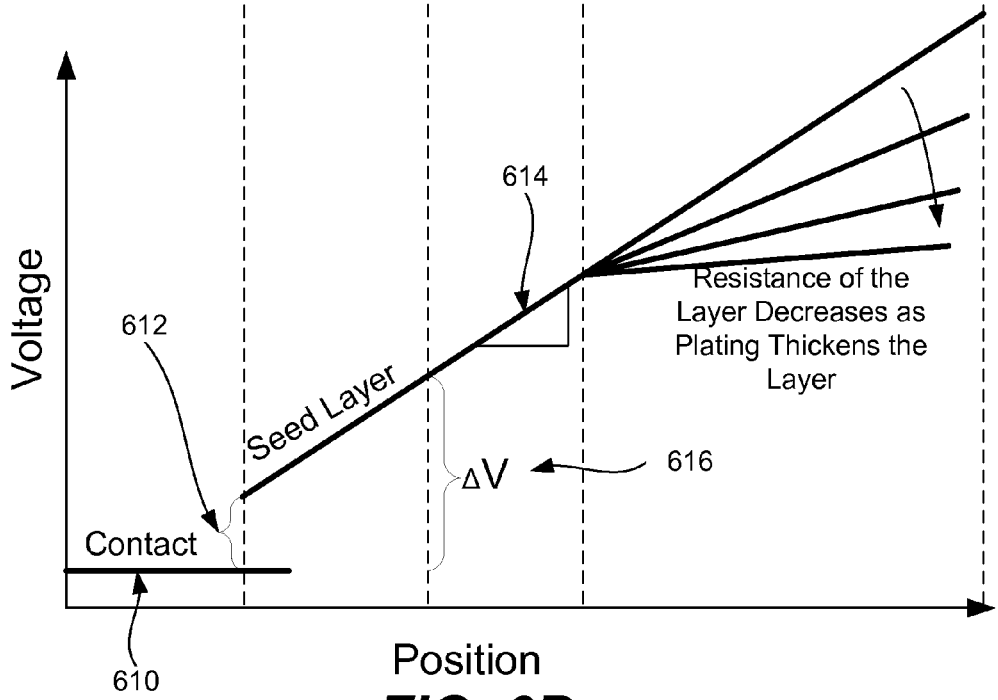

Another problem caused by rinsate in the contact area (and illustrated in the context of FIGS. 6A and 6B) is gradual destruction of the contact tips by depositing metals etched from the front surface. FIG. 6A illustrates a part of the clamshell during the electroplating operation where some rinsate residue is present in the contact area. FIG. 6B illustrates a corresponding plot of the voltage in the different components of the system and positions within the clamshell during electroplating process. The current is provided by the contact 208 and is applied to the front surface 306 around the wafer edge by the contact tip 220. The voltage within the contact is substantially constant (line 610) exhibiting only minimal drop caused by the small resistance of the contacts 212 material. Some voltage drop 612 occurs due to the contact resistance between the contact tip 220 and the wafer edge seed layer on the front side 306. The voltage then gradually increases (becomes more anodic as shown by line 614) moving inwards from the point of contact to the wafer center due to resistance of the front surface 306, e.g., a seed layer.

The combination of a voltage gradient 616 in the contact region and the rinsate residue 506, which contains some ions, creates an internal corrosion cell. The residue 506 completes the "electrochemical corrosion circuit" where metal (e.g., copper seed from the wafer) is oxidized right near the seal lip 212(*b*) resulting in metal ions released into the rinsate 506. The ionic current passes though the rinsate residue 506 from the front surface 306 to the contact tips 220 caused by the voltage gradient 616. The ionic current carries with it the metal ions that are plated as metal particles 620 onto the contacts 208. The oxidation/deposition process may become more severe as more rinsate accumulates in the contact area due to the higher voltage gradient 616 and larger front surface 306 exposed to the rinsate 506.

The particles 620 deposited onto the contact 212 typically have poor adhesion to the contacts and may be powderous or dendritic depending on the concentration of the electrolyte and the rate of deposition. For example, high ionic current combined with a dilute solution typically results in less adherent deposits that flake off as free particles. With various actions in the contact area (e.g., deflection of the contact tips and compression of the sealing lip, fluid flow, motions of the clamshell and other processes), loose particles can migrate past the seal edge 310 resulting in various edge defects on the wafer. Also, copper ions that are formed during oxidation of the front surface in the internal corrosion cell defined by the rinsate pool 506 form cuprous ions, i.e., $Cu^{+}$, (rather than cupric ions, i.e., $Cu^{2+}$) Two cuprous ions can combine (or disproportionate) to form copper metal particles/powders in the solution and a cupric ion. Such reduction of cuprous ions to elemental copper is a rapid process that can occur on any substrate (metallic/conductive or non-conductive) giving rise to poorly formed non-adherent copper deposits. More and bigger particles are formed when voltage differential is greater, as results from high electroplating currents and thinner front surface layers, e.g., seed layers. Because higher currents are desirable for high throughput processes while seed layers are becoming thinner in smaller circuit lines, edge defects resulting from the above described phenomena tend to become more severe.

Figure 7A:
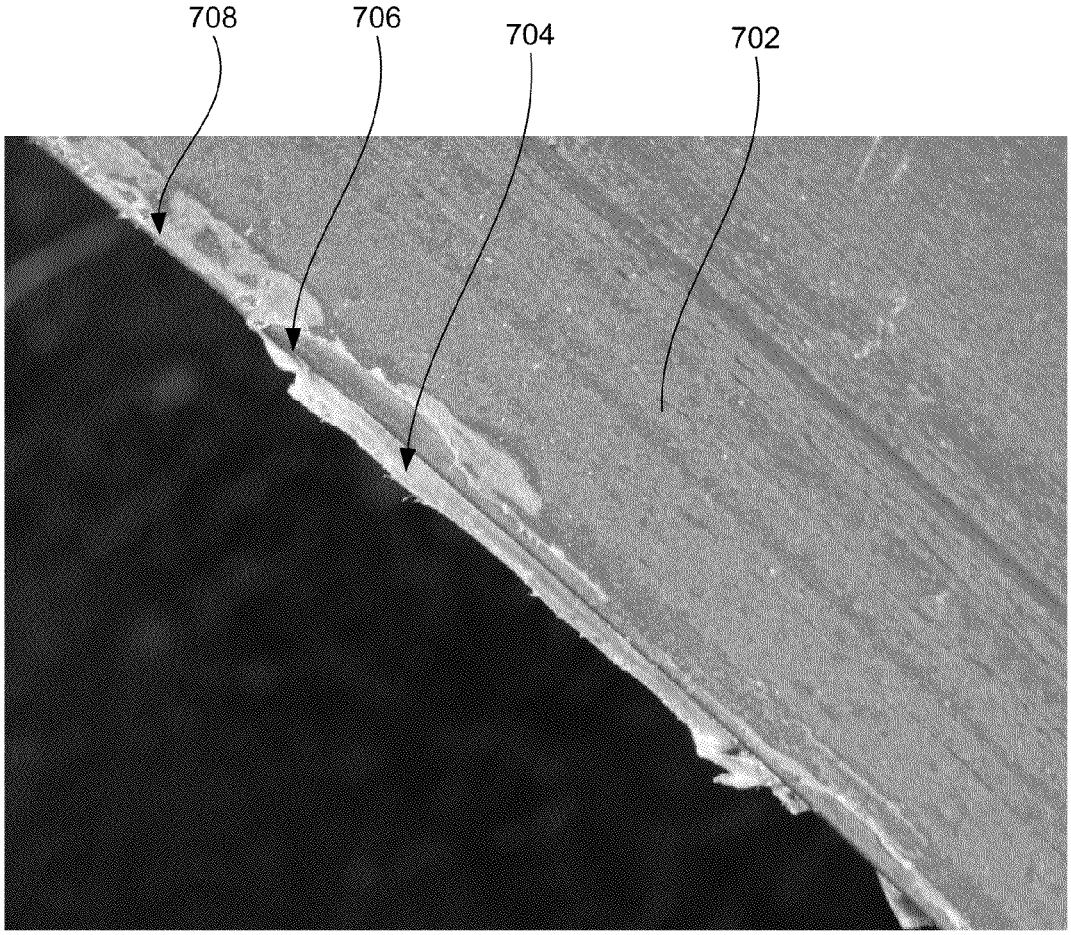
FIG. 7A illustrates the enlarge photograph of the Parylene coating on the cup bottom that has undergone between about 5,000-6,000 electroplating cycles.

The cup bottom 210 may be coated with an inert material, such as Parylene, to prevent corrosion and plating on the cup bottom 210. Generally, Parylene provides a good initial coating that is pinhole free and has adherent to the cup bottom. However, Parylene may wear off quickly and can start peeling after some use. FIG. 7A is a photograph of the Parylene coating on the cup bottom 702 that has undergone between about 5,000-6,000 cycles. The photograph shows the inner edge of the cup bottom (nearest the wafer). Some portions of the cup bottom 702 still have the coating. In other areas, the coating partially lost adhesion and is now permeable, such as a region 708. Yet in other areas, the coating is partially or completely gone, such as in a region 706, where the film 704 pealed back from the surface, damaged coating may lead to corrosion of the cup bottom and/or plating on the exposed metal surfaces. Both can result in loose particles and increase the risk of edge defects. Furthermore, Parylene is relatively hydrophilic and does not prevent formation of a large rinsate bead near the sealing lip. In certain embodiments, a coating of cup bottom is adherent, tough, wear resistant, pin hole free, and highly hydrophobic. Some examples of suitably hydrophobic materials include polyamide-imide (PAI), polyvinylidene fluoride (PVDF), and polytetrafluoroethylene (PTFE), their mixtures and copolymers.

In certain embodiments, the cup bottom is coated with a polyamide-imide (PAI) film. PAI is a thermoplastic polymer that is tough, chemically resistant, and thermally stable. Additionally, PAIs generally have superior hydrophobic properties to other polymers. The table below compares PAI to Parylene for typical electroplating solution showing that PAI is substantially more hydrophobic (has larger contact angles) with both deionized water and a virgin make-up solution (VMS).

TABLE 1

| Liquid | Paryelene Contact Angle | PAI Contact Angle |
|---|---|---|
| Deionized Water | 62° | 88° |
| Virgin Make-up Solution | 56° | 72° |

In specific embodiments, the cup bottom 210 is coated with two layers of Xylan P-92 and then two additional layers of Xylan 1010. In other embodiments, the cup bottom is coated with two layers of Xylan P-92 and then three additional layers of Xylan 1010. Both of these materials are supplied by Whitford Corporation in Elverson, Pa. Xylan P-92 is primarily a PAI polymer, while Xylan-1010 is about 70% PAI and about 30% PTFE. PTFE is a very hydrophobic polymer in its pure form but have marginal adhesion and ware resistance. A composite or co-polymeric film containing some PTFE in the outer-layer and predominantly PAI in the inner layer provides good hydrophobic, adhesion, and wear resistance characteristics. Even, a uniform film coated using Xylan P-92 may have appropriate hydrophobicity as evidenced in the table below.

In certain embodiments, a target thickness of the cup coating is between about 20 μm and 35 μm. Deposition may involve dissolving suitable polymers in a solvent, which may be heated to improve solubility. For example, n-methyl pyrrolidone (NMP) or dimethlyformamide (DMF) can be used for PTFE and PAI. Further, perfluorokerosene heated to at least about 350° C. may be used for PTFE. The dissolved polymers can be brushed on, spun on, or air spayed followed by high temperature curing. Other suitable coating techniques may also be used to form a film with above mentioned properties.

The coated cup plate may be inspected for pin holes using a spark test. This test may involve application of 90V voltage across the coating. Additionally, the coating thickness may be verified for each cup bottom to ensure adequate coverage. Other tests may include: an appearance test, where the PAI coating is inspected visually and under microscope to check for various film characteristics, an adhesion test (e.g., tape test), a pin hole test in a small electrochemical test cell using coupons with the PAI coating as a cathode and a copper strip as an anode and ramping voltage from 0V to 75V and observing the open circuit voltage.

Figure 7B:
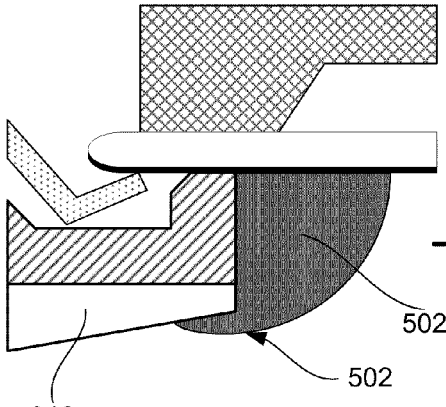
FIGS. 7B-C illustrate a part of the clamshell and a wafer before (FIG. 7B) and after (FIG. 7C) opening the clamshell and breaking the seal between the wafer and the clam shell, wherein the cup bottom is uncoated or coated with a moderately hydrophobic material.
Figure 7C:
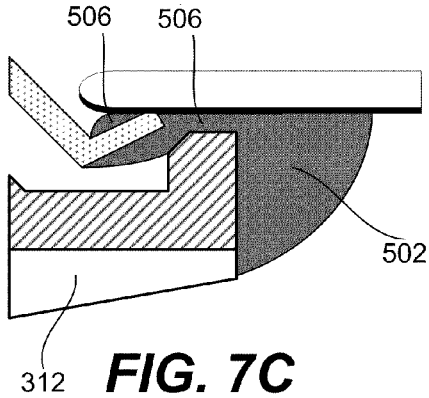
Figure 7D:
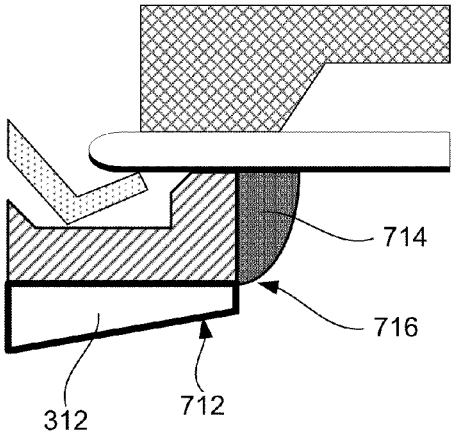
FIGS. 7D-E illustrate a part of the clamshell and a wafer before and then after opening the clamshell and breaking the seal between the wafer and the clam shell, wherein the cup bottom is coated with a highly hydrophobic material.
Figure 7E:
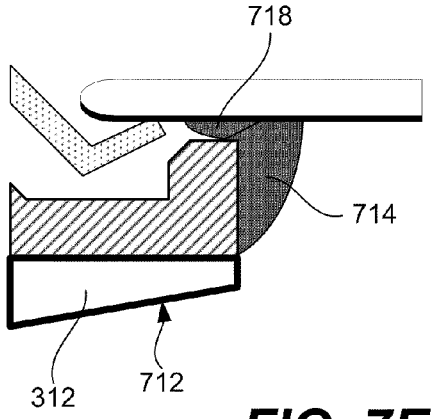

Switching to a more hydrophobic coating on the cup bottom may help to reduce the size of the rinsate bead formed near the sealing lip and the amounts of rinsate transferring into the contact area during opening as evidenced in FIGS. 7B-7E. In certain embodiments, substantially no rinsate is transferred into the contact area. FIGS. 7B and 7C represent a clamshell assembly where no coating or a less hydrophobic coating is used on the cup bottom 312 and generally correspond to FIGS. 5A and 5C described above. When a more hydrophobic coating 712 is used on the cup bottom 312 as shown in FIG. 7D, this coating may repel some rinsate leading to a smaller bead 714 formed near the sealing lip. For example, the bead may end at the interface of the lipseal and the tapered edge illustrated as 716. When the clamshell is opened as shown in FIG. 7E, much less rinsate is available for transferring into the contact area through the gap 718. In certain situations, the rinsate bead may extend into the gap but not enough to reach the contacts (and being additionally pulled by surface tension forces created during contact wetting). As a result, very little or substantially no rinsate may end up in the contact area.

Figure 8A:
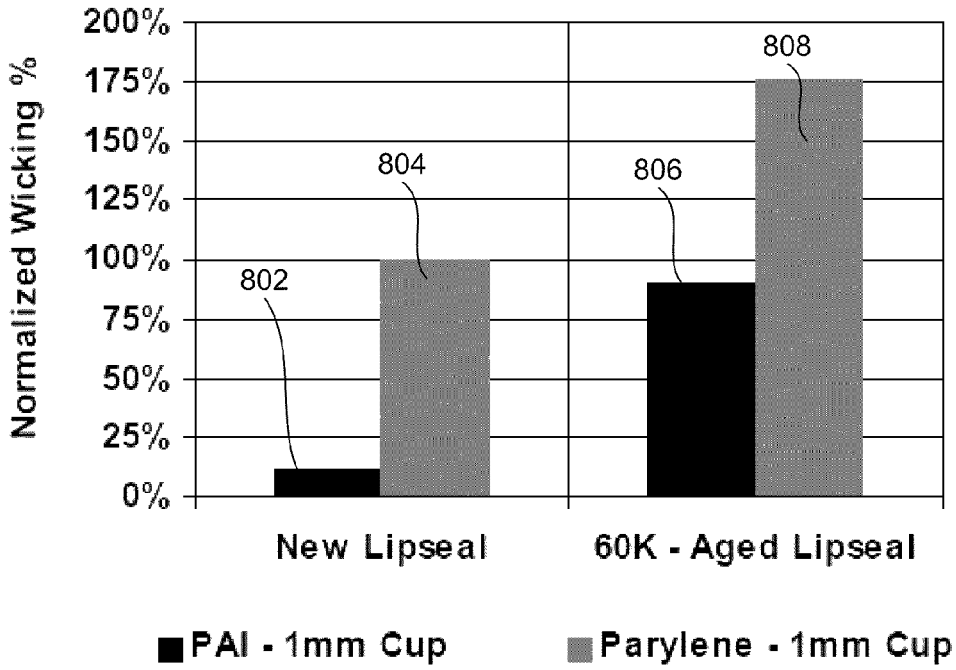
FIG. 8A is a plot comparing amounts of the electroplating solution wicked into the contact area of the clamshell for two different coatings of the cup bottom for both the new lipseal and a lipseal that has been used for about 60,000 electroplating cycles.

FIG. 8A is a plot comparing amounts of the electroplating solution wicked into the contact area of the clamshell for two different coatings of the cup bottom for a new lipseal and a lipseal that has undergone about 60,000 electroplating cycles. The plot indicates that using the PAI coated cup bottom (bars 802 and 806) results in less rinsate wicking into the contact region than using the Parylene coated cup bottom (bars 804 and 808). The PAI coating is more effective when used in combinations with both a new lipseal (bar 802 v. bar 804) and an aged lipseal (bar 806 v. bar 808).

Comparing different coatings in combination with differently aged lipseals allows eliminating any bias attributable to lipseals. Repeated cycling of the clamshell causes for a lipseal to deform, relax, wear, and loose any surface finish, such as a hydrophobic coating. As a result, more rinsate may wick into the contact region over time as the lipseal ages. In FIG. 8A, the amount of rinsate that wicked into the contact area with a new lipseal and a Parylene coating on the cup bottom is set to be 100%. After about 60,000 cycles, the same lipseal (but now aged) allowed additional 75% rinsate to wick into the contact region. When switching to the PAI coating results and a new lipseal, the initial wicking of only about 10%. For an aged lipseal, the rinsate wicking drifted towards 90%, which is still better than initial performance of the brand new lipseal in a combination with the Parylene coated cup bottom. Further, this experiment demonstrated that no peeling was observed on the PAI coating after about 60,000 cycles, which considerable improvement over results with the Parylene coating shown in FIG. 7A. Overall, switching to the PAI coating can allow smaller acceptable limits for wicked rinsate amounts (and thereby reduce edge defects) and/or less frequent preventive maintenance. For example, it has been preliminary estimated that preventive maintenance of a typical clamshell can be performed at lease twice less frequently by switching to the PAI coating on the cup bottom.

In another experiment, the PAI coating was tested for leaching and adsorption in the electrolyte environment. Two test samples were used. The first sample included two layers of the P92 coating and one layer of the Xylan 1010 coating. The second sample included only two layers of the Xylan P92 coating. Both samples were soaked for 16 days at 20° C. in a typical copper plating solution containing 40 g/L copper ions, 10% by weight sulfuric acid, and 50 ppm chloride ions. In addition, a control sample coated with Parylene was used. All samples were weighed before and after soaking. Additionally, all soaking liquids were analyzed using a Current-Voltage (cyclic voltammetry) analysis for changes in resistance and for detection of any electro-active materials that may have leached into the solutions. After soaking, the PAI coating did not demonstrate any detectable leaching or adsorption. This is a significant improvement in comparison over the Parylene coating, which experienced a slight weight gain and a small, at present unidentified cyclic voltametery peaks seen at a very negative reduction potential.

Figure 8B:
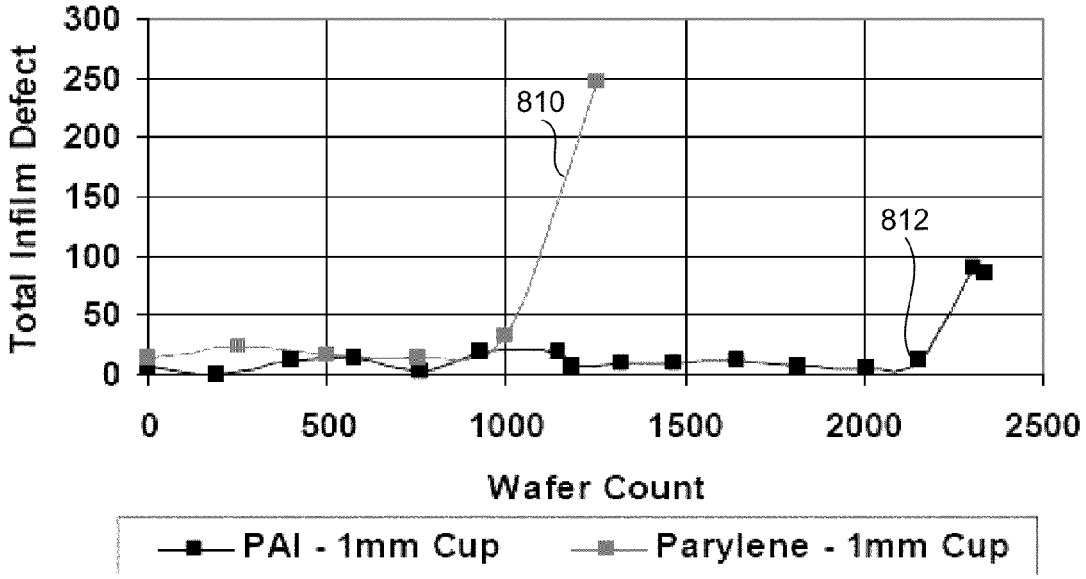
FIG. 8B is a plot comparing numbers of defects on the wafers as a function of the number of electroplating cycles, wherein the wafers have been electroplated in the clamshell apparatuses using the cup bottoms coated with the two different materials.

FIG. 8B is a plot comparing numbers of wafer defects as a function of the number of electroplating cycles performed in two clamshell apparatuses with different cup bottom coatings. Line 810 corresponds to the Parylene coating of the cup bottom, while line 812 represents the PAI coating. Wafers processed using the Parylene coated cup bottom started showing a substantial increase in the defect rate after about 1000 cycles. Without being restricted to any particular theory, it is believed that the Parylene coated cup bottom allowed more rinsate to wick into the contact region because of Parylene' s lower hydrophobicity resulting in defect excursion after much fewer cycles than the PAI coated cup bottom. Also, the Parylene coating might have lost its integrity to some extent during this cycling leading to more rinsate wicking into the contact region and causing the defects. Regardless of the cause, the PAI coating showed substantial improvements in performance. Many more wafers can be processed in the clamshell where the cup bottom is Parylene coated before contacts need to be cleaned or otherwise refurbished.

Figure 8C:
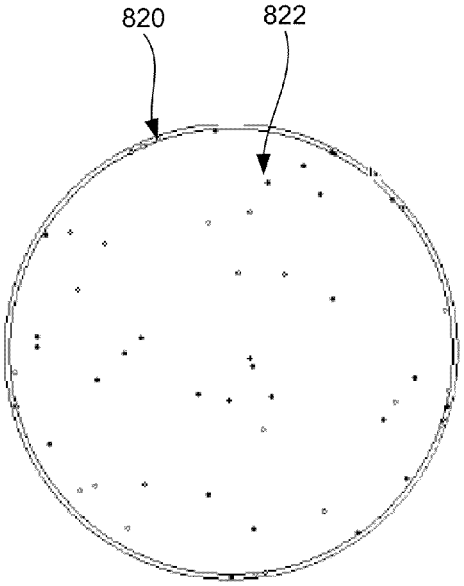
FIGS. 8C-D are illustrative representations of the wafer overlays that indicate defect distributions on the front sides of the wafers electroplated in the clamshell apparatuses using the cup bottoms coated with the two different materials.
Figure 8D:
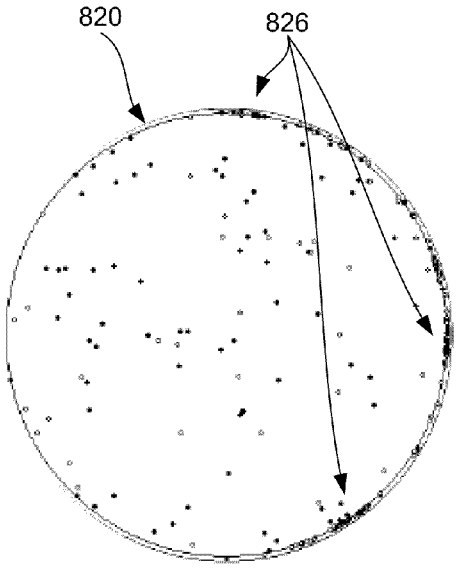

FIGS. 8C-D are illustrative representations of two wafer overlays that show defect distributions on the front sides of the wafers electroplated in the clamshell apparatuses having the cup bottoms coated with the two different materials. Images of six wafers were used construct each overlay image. FIG. 8C represents defect distribution on the wafers processed with the PAI coated cup bottom, while FIG. 8D—with the Parylene coated cup bottom. Each dot (e.g., 822) represents a defect on one of the six wafers, which images were used to create overlay. The two figures clearly show that the PAI coating corresponds to much fewer defects than the Parylene coating. Further, the defects corresponding to the Parylene coating tend to concentrate around the wafer edge 820, such as agglomerates 826, where chip density is also higher.

Another test showed that the PAI coated cup bottom yielded wafers with an average defect count of only 9.5 counts per wafer during 2,000 non-stop wafer cycles. The defects were measured by an AIT Defect analyzer supplied by a KLA-Tencor, Inc. in San Jose, Calif., which is capable of measuring defects that at least about 0.9 nm in size. The Parylene coated cup bottom showed an average defect count of 18.6 for the first 1,250 cycles during the similar non stop test run. Thereafter, the defect count went up dramatically to an average of 237 defects per wafer for subsequent cycles.

Figure 8E:
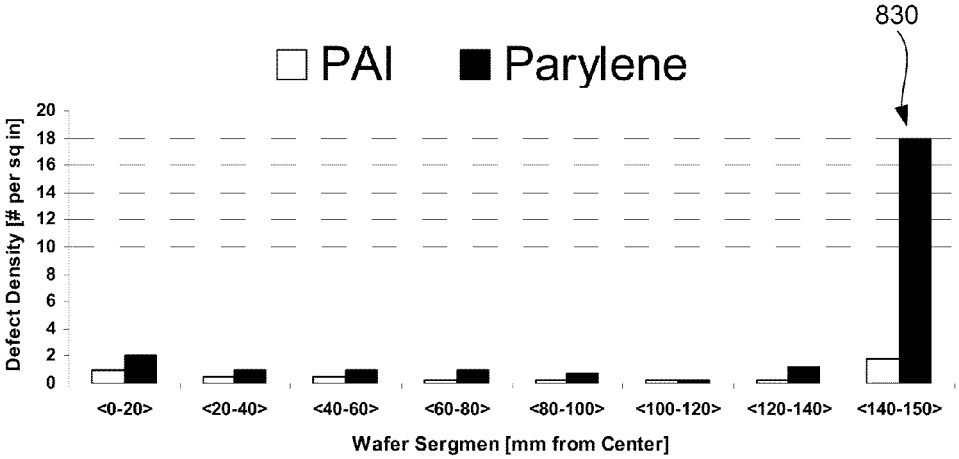
FIG. 8E is a plot comparing defect densities for different segments of the wafers electroplated in the clamshell apparatuses using the cup bottoms coated with the two different materials.

FIG. 8E is a plot comparing defect densities for different segments of the wafers electroplated in the clamshell apparatuses using the cup bottoms coated with the two different materials. The defect density, which is also referred to as defect distribution, is an average number of defects per square inch area in each segment. A segment is defined as a ring of having inner (represented by the first number) and outer (represented by the second number) diameters. For example, the first segment <0-20> specified on the plot corresponds to the inner circle with the diameter of 200 mm, while the last segment <140-150> corresponds to the outer most ring (around the edge of 300-mm wafers) with the inner diameter of 140 mm and the outer diameter of 150 mm. Defects corresponding to wafers processed with the PAI coated cup bottom are shown as white bars, while defects corresponding to wafers processed with the Parylene coated cup bottom are shown as black bars. Similar to overlays in FIGS. 8C and 8D, this plot illustrates that wafers processed with the Parylene coated cup bottom has more defects in each segment and particularly high increase around the edge (i.e., edge defects) as indicated by bar 830 corresponding to the segment defined by the distance from the center of between 140 and 150 mm.

Figure 9A:
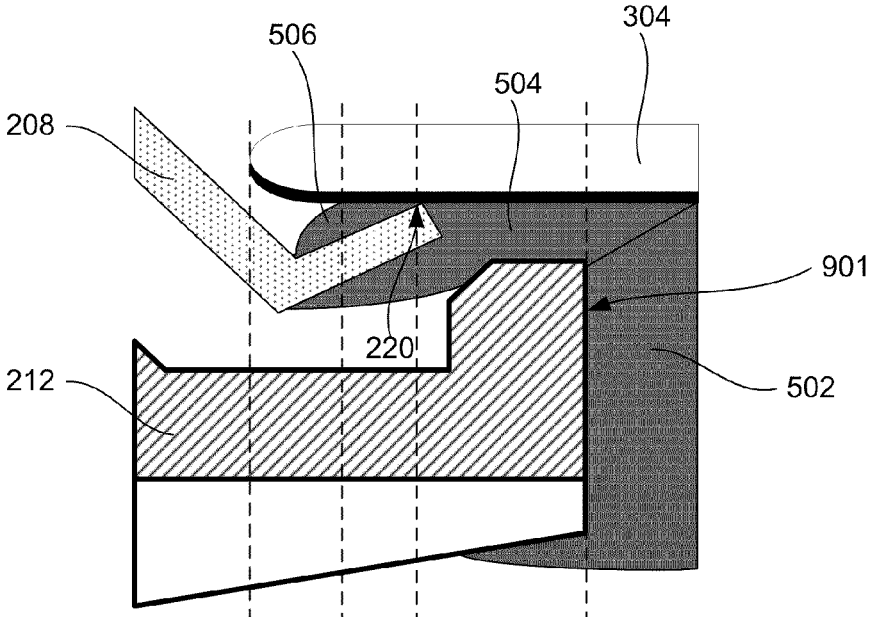
FIGS. 9A-B provide schematic representations of the clamshell apparatuses with the contacts positioned in different locations with respect to other components of the clamshell and the wafer.
Figure 9B:
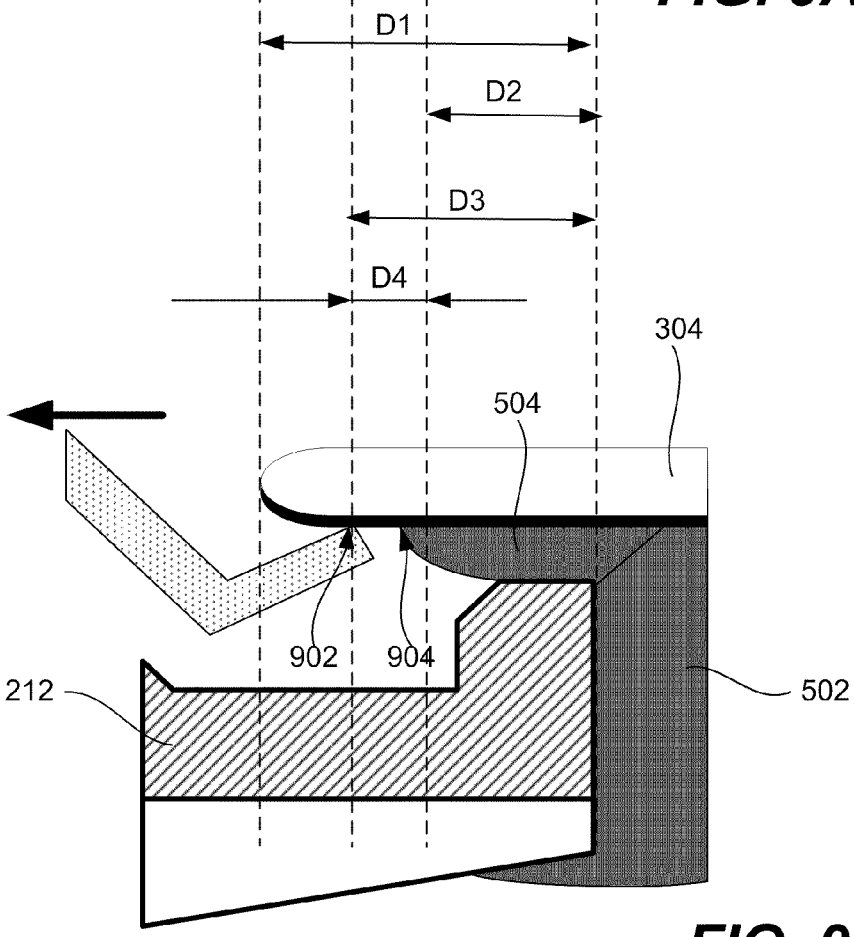

Described earlier in the context of FIGS. 5A-5C, during opening of the clamshell some rinsate migrates through the gap between the sealing lip and the wafer and can touch the contacts resulting in additional surface tension forces that pull more rinsate into the contact area. The distance that rinsate can travel through the gap depends on the bead volume and surface properties of the surrounding materials. In addition to or instead of reducing the bead volume and/or changing the cup bottom coating to more hydrophobic materials, the contact tips may be moved further away from the sealing lip in order to avoid wetting of the contacts and further spreading of the rinsate in the contact area. FIGS. 9A-B provide schematic representations of two different clamshell apparatuses during the opening operation with the contact tips positioned at different distances from the sealing lips. Specifically, the contact tips shown in FIG. 9B are further away from its sealing lip by distance D4 than the contact tips shown in FIG. 9A. In both illustrations the outermost edge 901 of the lipseal 212 is positioned at a distance D1 from the edge of the wafer 304. D1 represents a non-plated and, therefore, unusable area of the wafer for devices. D1 may be between about 1.0 and 5.0 mm, more specifically between about 1.0 and 2.0 mm. Generally, it may be desirable to keep this distance as short as possible without sacrificing the electrical contact between the contact tips and the front surface of the wafer and contamination of contacts in the area. In FIG. 9A, the contact point 302 is posited at a distance D2 from the outermost edge 901, which may be between about 0.3 mm and 0.8 mm. This distance may not be sufficient (as shown in FIG. 9A) to prevent the rinsate residue 502 from traveling through the gap 504 and wetting the contact 208 resulting in a droplet 506 formed around the contact 208. It should be noted that the minimal distance at which the contacts may remain dry depends on a number of factors, such as a size of remaining rinsate bead and materials of the lipseal 212. In FIG. 9B, the contact point 902 is posited at a distance D3 from the outermost edge 901 of the lipseal 212, which may be between about 0.8 mm and 1.6 mm. In this example, the contact 208 is sufficiently far enough from the outermost edge 901 and the wicked rinsate 504 does not reach and wet the contacts during opening of the clamshell as shown by point 904. As a result, no droplets around the contacts 208 are formed.

Figure 10A:
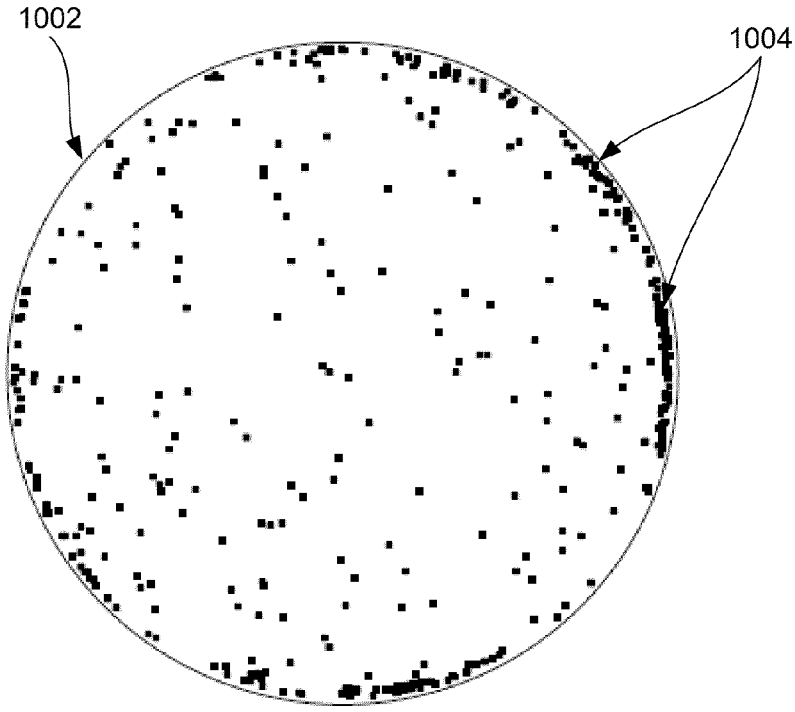
FIGS. 10A-B are illustrative representations of the wafer overlays that indicate defect distributions on the front sides of the wafers electroplated in the clamshell apparatuses using contacts positioned in different locations with respect to other components of the clamshell and the wafer.
Figure 10B:
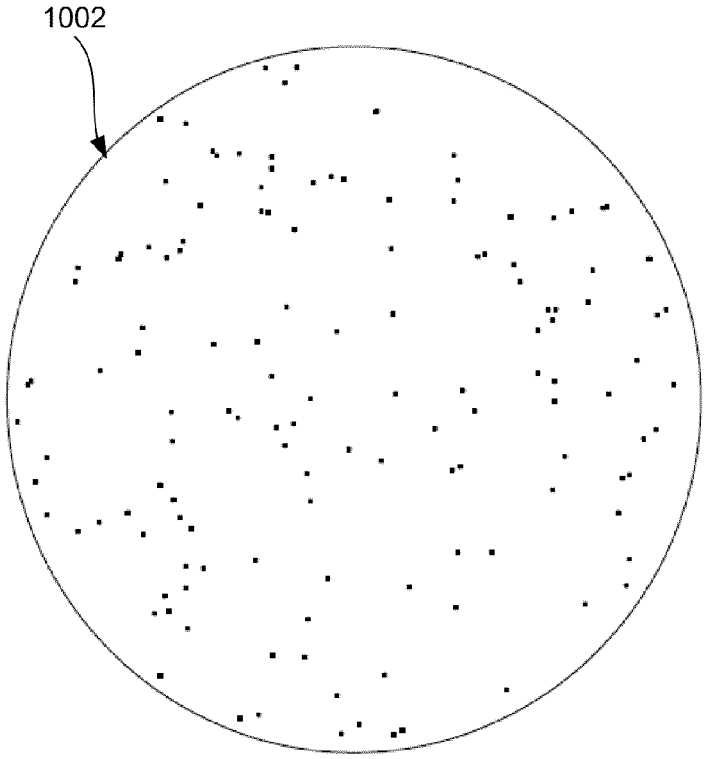

FIGS. 10A-B illustrate two overlays indicating defect distributions on the wafers electroplated in the clamshell with contact tips positioned at different distances with respect to the lipseals. In one clamshell, the contact tips were positioned at 0.6 mm from the lipseal edge (distance D2 as in FIGS. 9A-B). The overlay shown in FIG. 10A corresponds to the wafers processed in this clamshell. In another clamshell, the contact tips were positioned at 1.4 mm from the lipseal edge. The overlay shown in FIG. 10B corresponds to the wafers processed in this second clamshell. It should be noted that the wafer position relative to the lipseal edge (distance D1 in FIGS. 9A-B) was the same (1.75 mm) for both clamshells. Overall, wafers processed in the clamshell with the contacts positioned closer to the lipseal show significantly more edge defects 1004 and higher defect concentration near edges 1002. The statistical analysis of the defect categories as well as Scanning Electron Microscope images indicated that the defects corresponding to the FIG. 10B overlay were primarily surface particles and not pits.

Figure 12A:
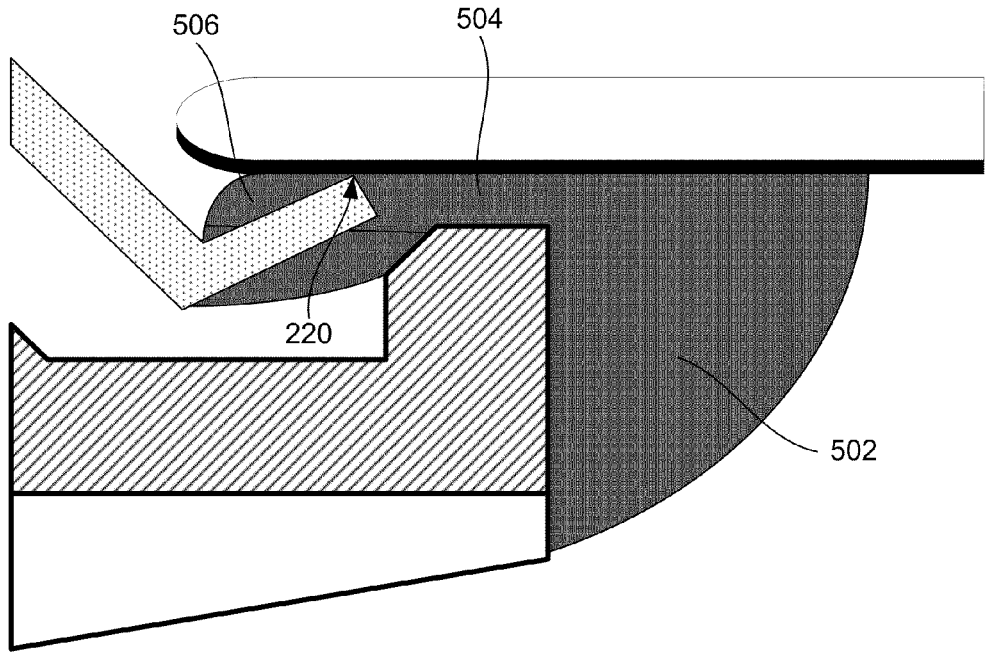
FIGS. 12A-B provide comparative schematic representations of the two clamshell apparatus designs, wherein the design shown in FIG. 11B has a hydrophobic coating on the electrical contacts to prevent excessive wicking of the electroplating solution into the contact area after breaking the seal.
Figure 12B:
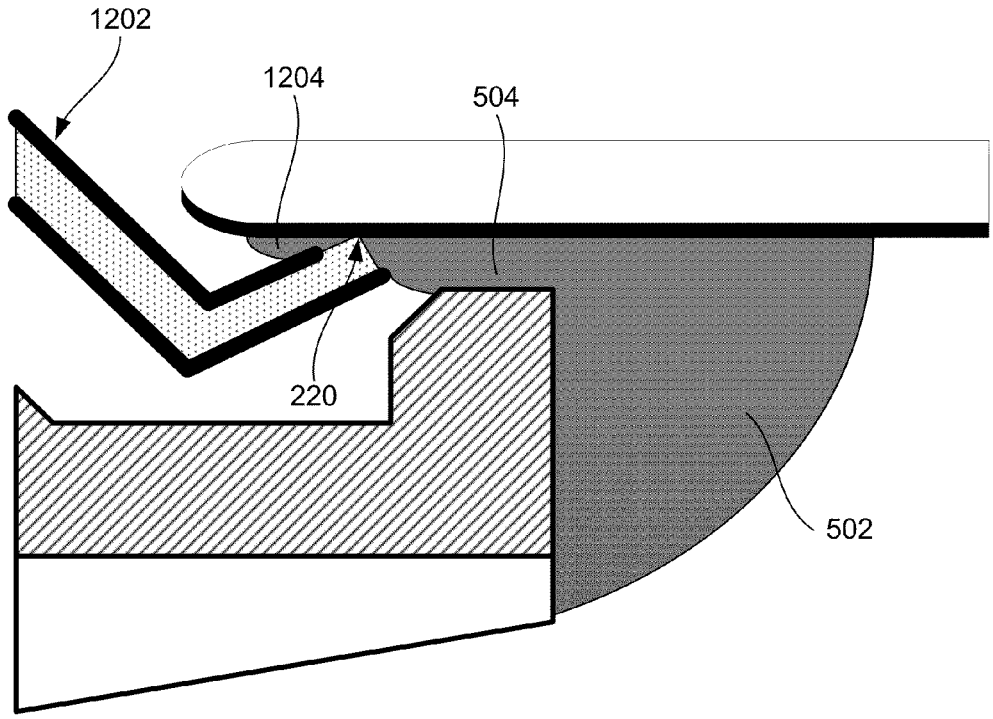

Even though some rinsate may propagate into the contact area and touch the contacts, this amount of rinsate may be reduced by making the surface of the contacts less hydrophilic. In other words, when some rinsate reaches and touches the contacts, the associated surface energy repels the rinsate. In certain embodiments, the contact is fully or partially coated with a hydrophobic polymer coating, such as polytetrafluroethylene (PTFE or Teflon™), ethylene-tetrafluoroethylene (Tefzel™), Polyimide-amide (PAI), or polyvinylidene fluoride (PVDF), to aid in the expulsion and rejection of rinsate from the contact area. FIGS. 12A-B provide comparative schematic representations of two clamshell apparatus designs, wherein the design shown in FIG. 12B has a hydrophobic coating on the electrical contacts to prevent excessive wicking of the electroplating solution into the contact area after breaking the seal. FIG. 12A generally corresponds to FIG. 5C described above and presented as a reference. The design illustrated in this figure does not include a hydrophobic coating on the contacts and, as a result, a relatively large amount of rinsate 506 ends up in the contact area. In FIG. 12B, the entire surface of the contact but the contact tip 302 that is needed to establish a contact with the front side of the wafer is shown coated with a hydrophobic polymer 1202. Examples of methods of forming such a contact structure include, but is not limited to, first completely coating the contact element (e.g., a contact finger), for example, by dip coating in a melted polymer, or spraying the contacts with a polymer dissolved in a solvent and allowing the solvent to dry. The coating is then selectively removed from the contact tip area 302 by selective physical abrasion or selective exposure of the tip to a solvent. In certain embodiments that are not illustrated, the entire contact may be coated with a conductive polymer coating.

Figure 11A:
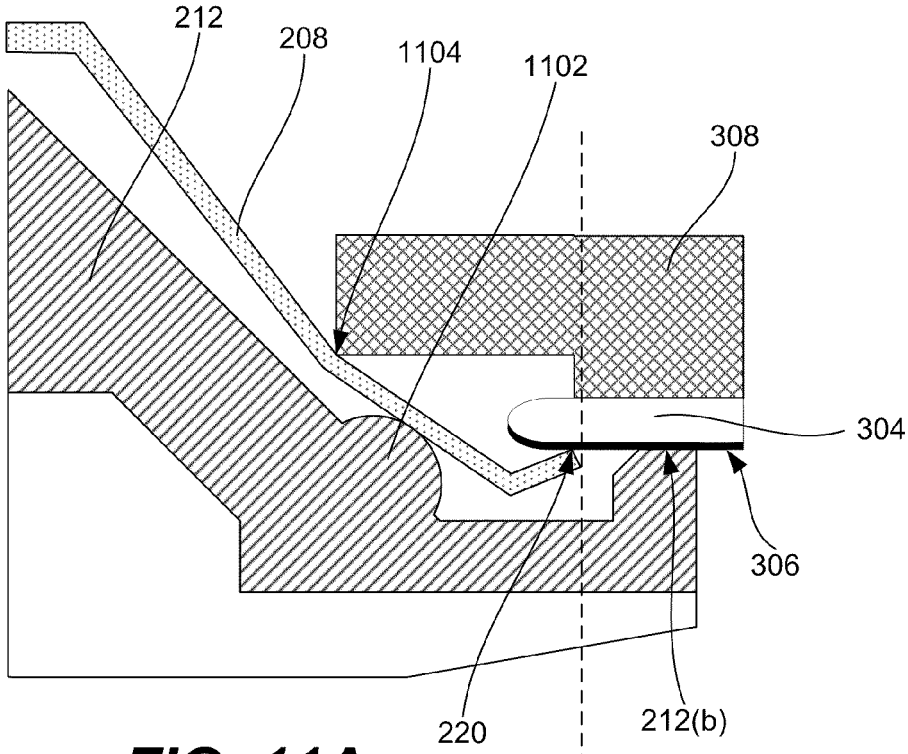
FIGS. 11A-B provide schematic representations of the clamshell apparatus design shown in a closed and open states, wherein the electrical contacts are removed away from the front surface of the wafer before breaking the seal.
Figure 11B:
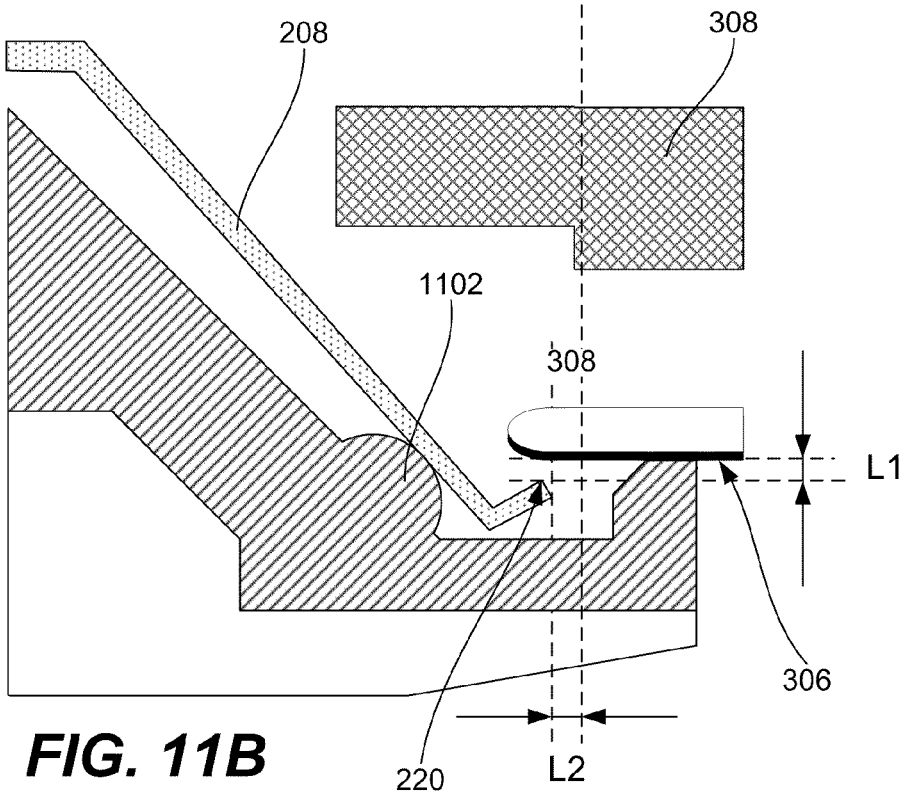

When the seal is broken during the opening operation, the rinsate may be drawn into the contact area usually due to surface forces created by the hydrophilic front side of the wafer. For example, the front side typically has a copper seed layer that is wetted by the rinsate causing it to spread over the front surface. As shown in the context of FIGS. 5B and 5C, the rinsate then may reach the electrical contact tips, which are in contact with the front surface during opening (the contact tips typically extend higher than the lipseal and may remain in contact with the front surface after the seal is broken). If the contact tips are separated from the front surface before the seal is broken or at least before sufficient amount of rinsate propagated into the contact area, then wetting of the tips may be avoided or minimized. FIGS. 11A-B provide schematic representations of a clamshell apparatus design in which the contact tips are retrieved from the front side surface during the opening of the apparatus. These figures show a particular example of a method wherein the contact tips position relative to the wafer front surface are dynamically movable during the opening and closing of the clamshell. FIG. 11A illustrates the clamshell apparatus in a closed state, while FIG. 11B illustrates the same clamshell apparatus in the open state. In the open state the electrical contacts are removed away from the front surface of the wafer before or at some point during breaking the seal between the lipseal and the front surface. As shown in FIG. 11A in the closed clamshell the contact points 302 are forces upwards by the action of the cone 308, the flexure 1104 in the contact 208 and a fulcrum 1102 of the lipseal 212. The force exerted on the contact 208 by the cone 308 causes it to deflection. The fulcrum 1102 acts as a support for the lever which translated the downward motion of the cone at the flexure point 1104 into the upward motion of the contact tips 220. When the clamshell opens as it is shown in FIG. 11B, the cone 308 is retracted removing its pressure on the contact 208. The contact 208 relaxes and its contact point 220 moves away from the wafer surface 306. The contact tip 220 may move both down away from the wafer surface 306 (as shown by distance L1 in FIG. 11B) and in the direction away from the outermost edge 901 of the lipseal 212 (as shown by distance L2 in FIG. 11B). In some embodiments, the contact tips 220 may only move in one of these directions. Removing the contact tips 220 from their original position may eliminate wetting of the tips with the rinsate and minimize (or eliminate) rinsate accumulations in the contact area.

Figure 13:
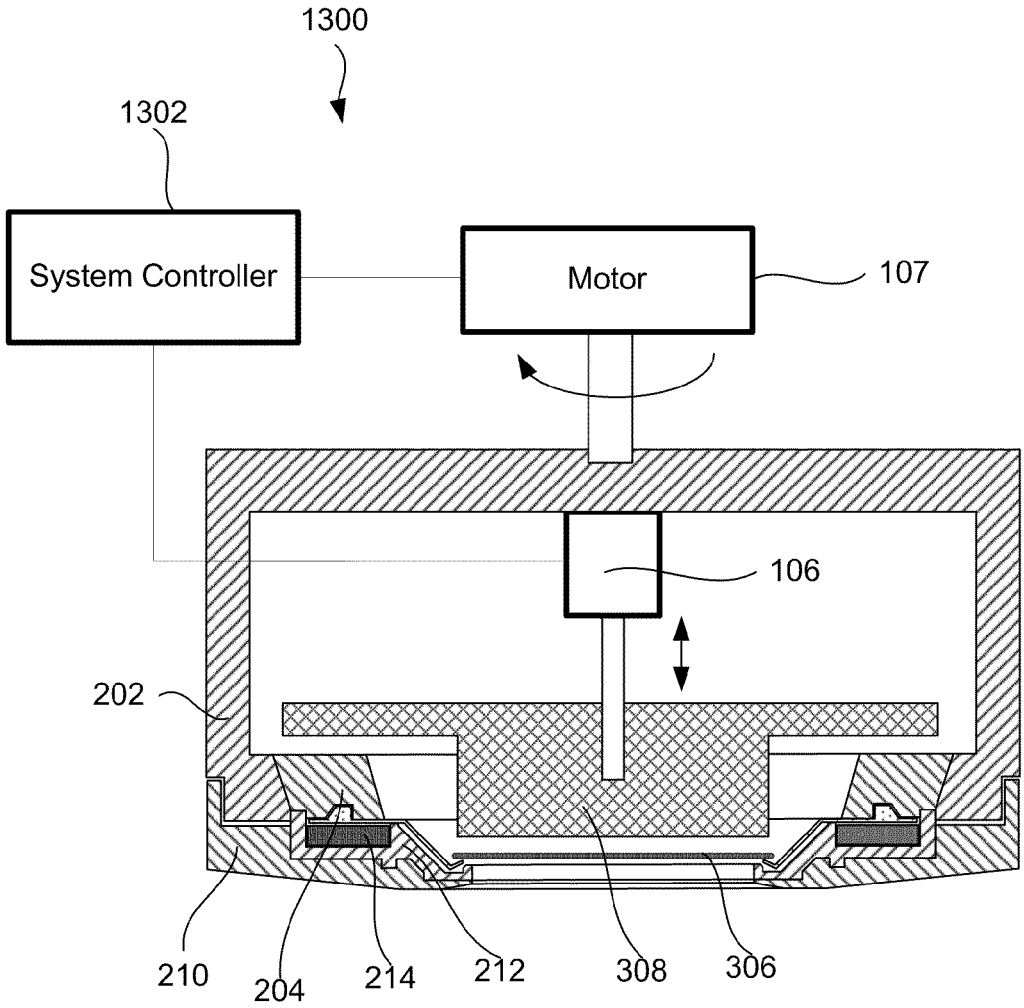
FIG. 13 illustrates a schematic representation of the clamshell with a cone lifting and a clamshell spinning mechanisms.

FIG. 13 illustrates a schematic representation of the clamshell apparatus 1300 in accordance with certain embodiment. The apparatus 1300 may have a motor 107 for rotating the clamshell (elements 202, 204, 210, 212, 214, 306, 308 and other) and a shaft 106 with an air cylinder for lifting a cone 308 inside the apparatus. The motor 107 and the shaft 106 are further described in the context of FIG. 1. Operations of the motor 107 and the air cylinder may be controlled by a system controller 1302. In certain embodiments, a system controller 1302 is employed to control process conditions during copper deposition, insertion and removal of wafers, etc. The controller 1302 may include one or more memory devices and one or more processors with a CPU or computer, analog and/or digital input/output connections, stepper motor controller boards, etc.

In certain embodiments, the controller 1302 controls all of the activities of the deposition apparatus. The system controller 1302 executes system control software including sets of instructions for controlling timing, rotational speeds, lifting speeds, and other process parameters. Other computer programs and instruction stored on memory devices associated with the controller may be employed in some embodiments.

Typically there will be a user interface associated with controller 1302. The user interface may include a display screen, graphical software displays of the apparatus and/or process conditions, and user input devices such as pointing devices, keyboards, touch screens, microphones, etc.

The computer program code for controlling electroplating processes can be written in any conventional computer readable programming language: for example, assembly language, C, C++, Pascal, FORTRAN, or others. Compiled object code or script is executed by the processor to perform the tasks identified in the program. Signals for monitoring the process may be provided by analog and/or digital input connections of the system controller. The signals for controlling the process are output on the analog and digital output connections of the deposition apparatus.

The system software may be designed or configured in many different ways. For example, various apparatus component subroutines or control objects may be written to control operation of the apparatus components necessary to carry out the inventive electroplating processes. Examples of programs or sections of programs for this purpose include wafer code, spinning speed control code, lifting speed control code, and other codes. In one embodiment, the controller 1302 includes instructions for electroplating conductive lines in a partially fabricated integrated circuit.

Figure 14A:
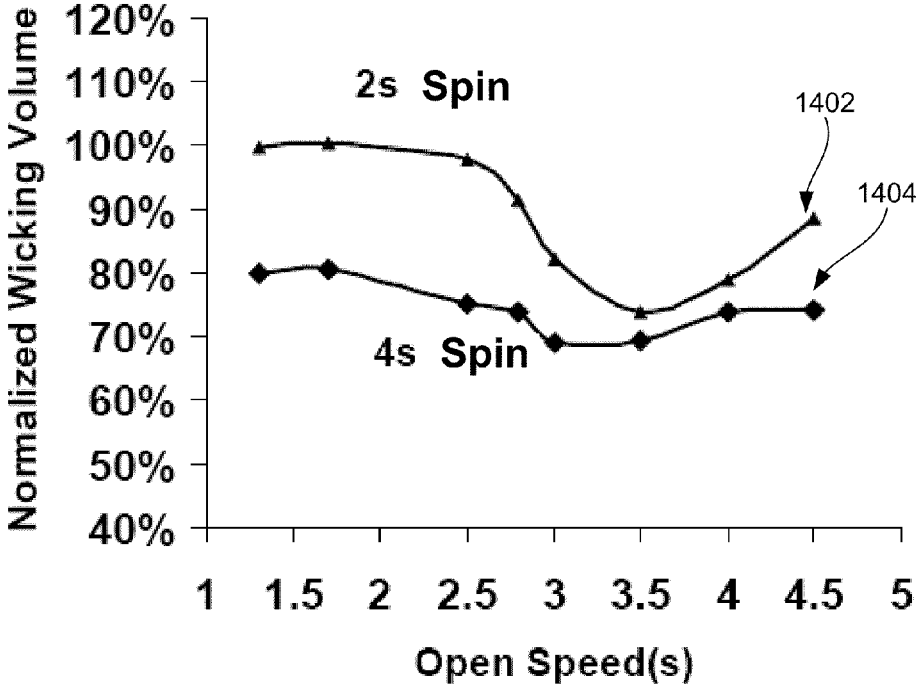
FIG. 14A illustrate a plot of the normalized wicking volume of the electroplating solution into the contact area as a function of the opening speeds of the clamshell for two different spinning durations.

It has been determined that the clamshell opening speed (i.e., the speed at which the cone is moved away from the cup bottom, the action of which is one step in a sequence required for the extraction of the wafer from the cup/cone clamshell assembly) has an effect on rinsate wicking into the contact area and edge defects. Without being limited by any particularly model or theory, it is believed that slower opening speeds cause less suction in the contact area resulting in reduced wicked amounts. However, further reducing the opening speeds causes the wicking volume to increase, which may be due to capillary action while wafer is waiting to be picked out of the cup. FIG. 14A is a plot of the normalized rinsate volume wicked into the contact area as a function of the opening speeds two different spinning durations. In both tests, a fixed spin rotation speed of 600 rpm was used for either two seconds (line 1402) or four seconds (line 1404). The spinning was performed after a two second rinse with deionized water from a fan spray nozzle located below and to the side the wafer and flowing at a rate of 1.5 liters per minute (a total delivered volume of about 50 ml). The vast majority of the rinsate is spun off the wafer and is directed to a separate containment area to avoid diluting the plating bath located below the wafer. Some fluid remains on the wafer surface and in the edge region of the clamshell near the lipseal as it was explained in the context of FIG. 5A above. A longer spinning time (line 1404) reduces the amount of the fluid wicked from the front side and lipseal interface into the contact area. The four seconds spinning (line 1404), which potentially has a somewhat smaller amount volume available for wicking at the peripheral edge at the lipseal, appears to desensitize wicking to opening speed and also minimizes impact from hardware variability. However, longer spinning time reduces product throughput and, therefore, a shorter spin time with an optimized open speed may be preferred. The plot indicates that the optimal opening speed is between about 3 and 4 seconds. It should be noted that all opening speeds are specified for a travel of about 2.25 inches (or 5.7 centimeters), which, in certain embodiments, corresponds to an overall travel distance of the cone during opening of the clamshell. Therefore, an opening speed expressed as 1.7 seconds correspond to an actual speed of 3.3 centimeters per second, while an opening speed expressed as 3.5 seconds corresponds an actual speed of 1.6 centimeters per second, and so on. For example, by slowing the opening from 2.5 seconds to 3 seconds, the amount of rinsate wicked into the contact area may be reduced by about 20%. While slowing the opening operation also negatively impacts the throughput, the impact is believed to be less severe than for example increasing the spinning duration to achieve the same effect.

Figure 14B:
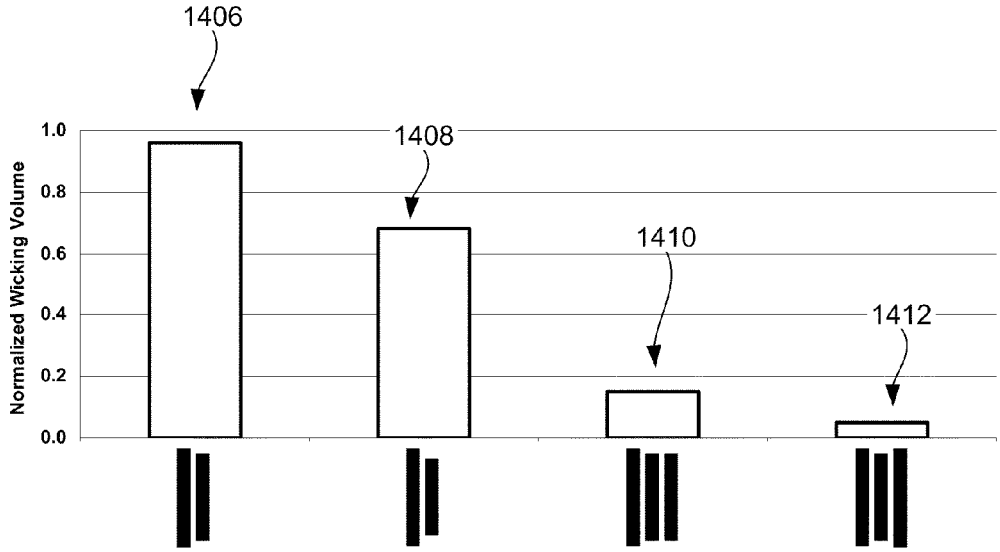
FIG. 14B illustrate a comparative plot of the normalized wicking volume of the electroplating solution into the contact area for different process conditions and clamshell designs.

FIG. 14B is a comparative plot of the normalized wicking rinsate volume for different process conditions and clamshell designs. The plot indicates that both apparatus and process adjustments can minimize wicking. For example, by slowing the opening process from 1.7 seconds to 4 seconds and by increasing spin drying from 2 seconds to 3 seconds, wicking may be reduced by about 30% (comparing bars 1406 and 1408). Substantial improvements were observed by coupling the new process parameters (slower opening and longer drying) with the cup bottom coated with PAI (bar 1410). The wicked rinsate amount decreased by an additional 50%. Even more effective was replacing conventional contacts with new contacts positioned further away from the seal (bar 1412).

Figure 15A:
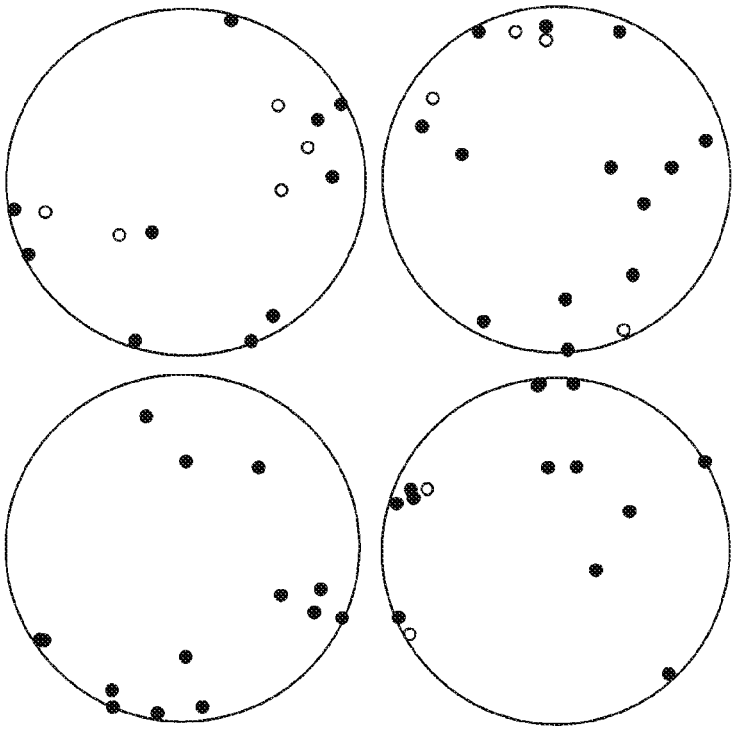
FIGS. 15A-B are illustrative representations of the wafer overlays that indicate defect distributions on the front sides of the wafers electroplated in the clamshell apparatuses using different process conditions.
Figure 15B:
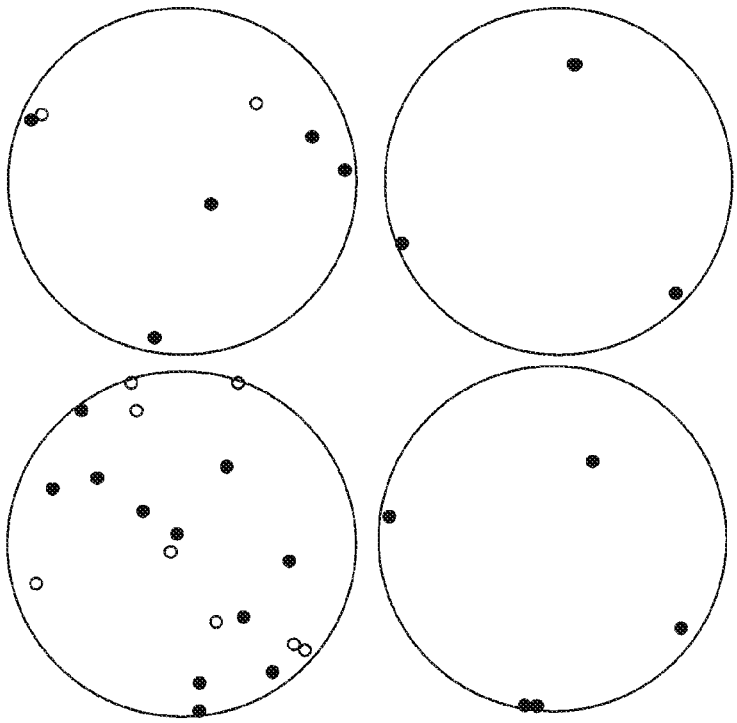

FIGS. 15A-B illustrate wafer overlays showing defect distributions on the wafers electroplated using different process conditions. Overlays in FIG. 15A corresponds to the process with the opening duration of about 2.5 seconds and drying duration of about 2 seconds at 600 RPM. Overlays in FIG. 15B corresponds to the process with the opening duration of about 3.0 seconds and drying duration of about 4 seconds at 600 RPM. The second set of the overlays showed substantially fewer defects, which indicate that wafer quality can be improved with these new process parameters. These results correspond to the one shown in FIG. 14B (bars 1406 and 1408).

Figure 16:
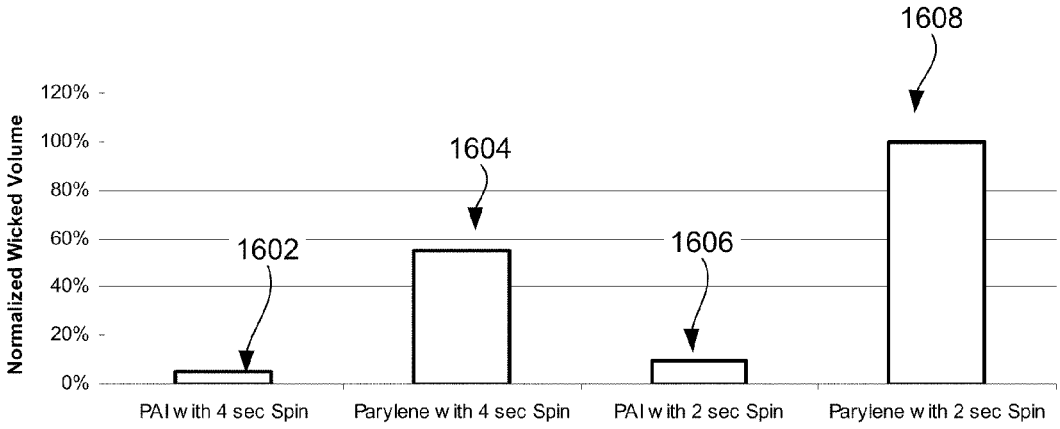
FIG. 16 illustrates a comparative plot of the normalized wicking volume of the electroplating solution into the contact area for different process conditions and clamshell designs.

FIG. 16 is a comparative plot of the normalized wicking rinsate volume for different process conditions and clamshell designs. The first bar 1602 corresponds to a test performed with the PAI coated cup bottom where the clamshell was spun for four seconds before opening. This combination of improvements showed the best result with the wicked amount of only 5% of the control sample (bar 1608) where the Parylene coated cup bottom was spun for only two seconds. Further, comparing results for the PAI coated cup bottom spun for two seconds (bar 1606) to results for the Parylene coated cup bottom spun for four seconds, it becomes evident that the coating of the cup bottom has, in some embodiments, a greater effect than spinning time. Overall, the graph indicates that the PAI coated cup bottom in combination with the four second spinning duration 1602 has the least wicking volume among tested alternatives.

Figure 17A:
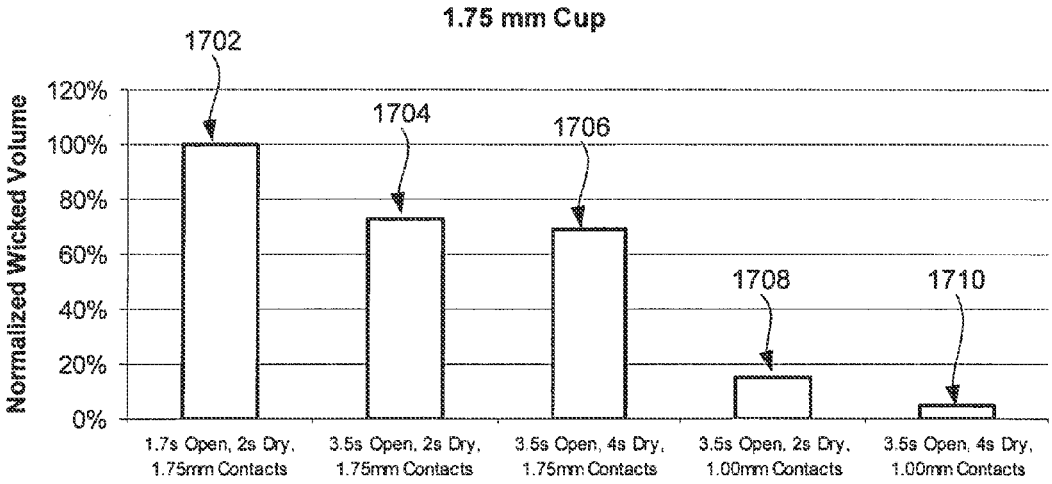
FIGS. 17A-B illustrate comparative plots of the normalized wicking volume of the electroplating solution into the contact area for different process conditions and clamshell designs.

FIG. 17A is a comparative plot of the normalized wicking rinsate volume for different process conditions and clamshell designs. In all tests, the same design of the lipseal was used in which the edge of the sealing lip is configured to be at about 1.75 mm from the wafer edge (i.e., distance D1 is 1.75 mm as shown in FIGS. 9A-B), i.e., "a 1.75 mm lipseal". These lipseals were matched with two different contact types. One type, 1.75 mm contacts (bars 1702, 1704, and 1706), was designed to be used with this design of a lipseal (with 1.75 mm spacing as described above). In a combination with this lipseal, the tips of the 1.75 mm contacts were separated from the edge of the sealing lip (distance D2 in FIGS. 9A-B) by about 0.4 mm. Another type of contacts, 1.00 mm contacts (bars 1708 and 1710), was designed to be used with a lipseal that has a sealing lip spaced only 1.00 mm from the edge of the wafer. As a result, a 1.00 mm contact has its contact tips positioned closer to the edge of the wafer than a 1.75 mm contact. When a 1.00 mm contact is used with a 1.75 mm wafer, the tips of the 1.00 mm contacts were separated from the edge of the sealing lip (D2 distance in FIGS. 9A-B) by about 1.4 mm, which is about 1.0 mm further away than in a 1.75 contact/1.75 mm lipseal combination.

The control sample (bar 1702) corresponds to tests performed in clamshell with a 1.75 mm contact in which the drying duration was 2 seconds and the opening duration was 1.7 seconds. Increasing the opening time to 3.5 seconds while keeping all other parameters the same resulted in a 25% decrease of the wicked rinsate (bar 1704). Another slight decrease (bar 1706) was a result of increasing drying time. When a 1.00 mm contact was used in a combination with a 3.5 seconds drying, the decrease was over 80% (bar 1708). However, increasing duration time to 4 seconds allowed decreasing the wicked volume even further. Overall, a combination of a slower opening speed, a longer drying duration, and a contact with tips further away from the sealing lip allowed achieving the best results. While some parameters, such as a different contact design, seem to more dominant than others, certain synergies were observed by combining various parameters, such as increasing drying time in a combination with a 1-mm contact (e.g., comparing bars 1704 and 176 to bars 1708 and 1710).

Figure 17B:
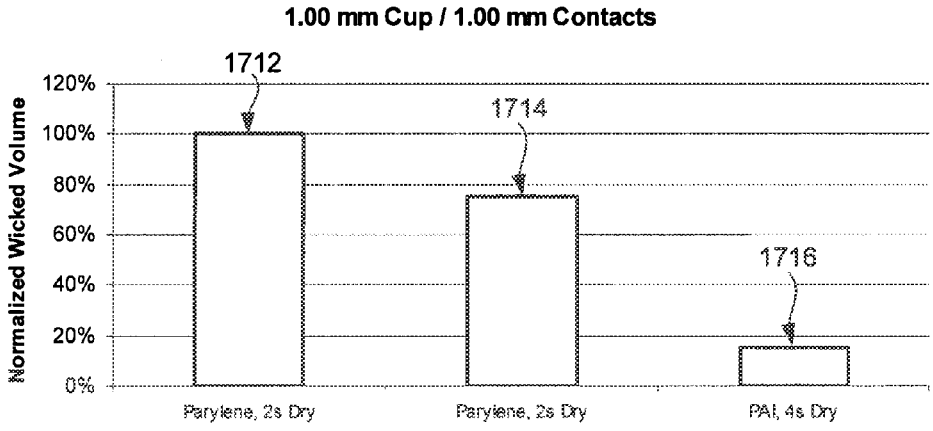

FIG. 17B is a comparative plot of the normalized wicking rinsate volume for different drying durations and cup bottom coatings. The control sample (bar 1712) corresponds to tests performed in a clamshell with a Parylene coated cup bottom and employing a 2 second drying. Increasing the drying duration to 4 seconds resulted in about 25% less rinsate wicked into the contact area. However, switching to a PAI coated cup bottom and a 4 second drying time helped to reducing wicking by about 85%.

Figure 18A:
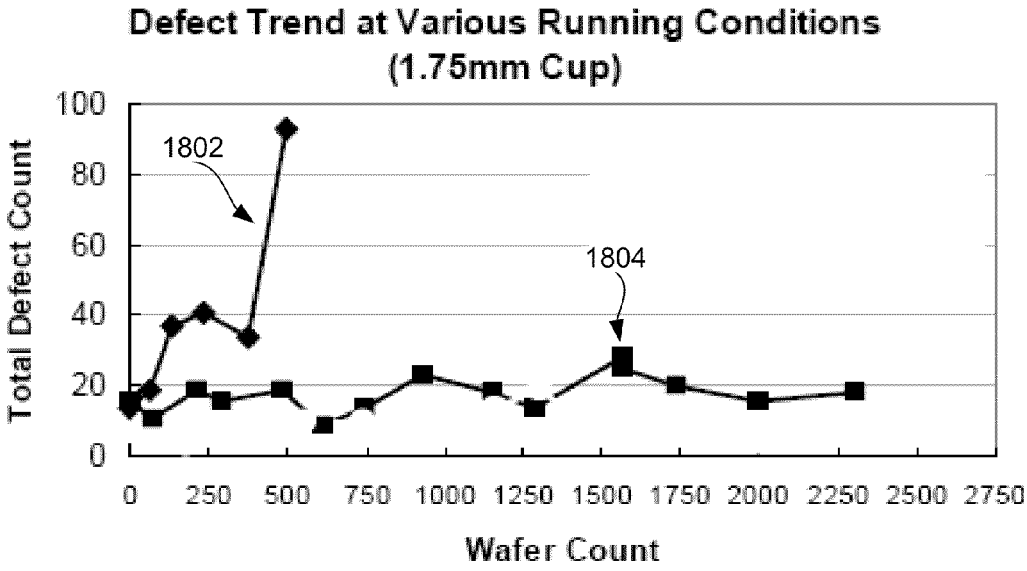
FIGS. 18A-B illustrate comparative plots of the normalized wicking volume of the electroplating solution into the contact area as a function of number of processed wafers for different process conditions and clamshell designs.
Figure 18B:
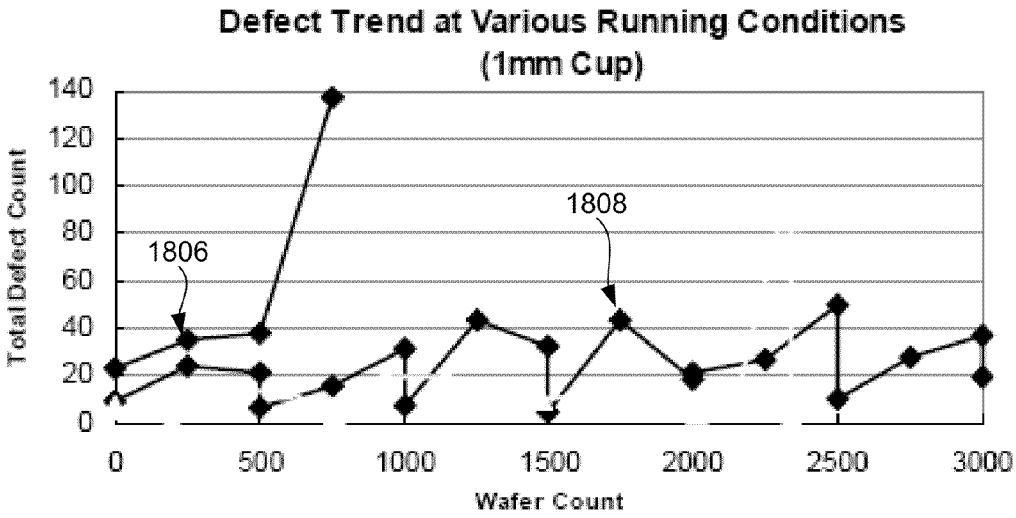

FIG. 18A-B are comparative plots of the process defects as a function of a number of processed wafers for different process conditions and clamshell designs. Line 1802 corresponds to a 1.75 mm contact design in a 1.75 mm cup and lipseal as explained above (i.e., D1=1.75 mm and D2=0.4 mm in the context of FIGS. 9A-B) and 2 second spinning and 1.7 second opening. Line 1804 corresponds to a 1.00 mm contact design in a 1.75 mm cup and lipseal (i.e., D1=1.75 mm and D2=1.4 mm), 4 second spinning, and 3.5 second opening. The later clamshell design and process conditions allows over 2,250 electroplating cycles without a need for preventing maintenance, while the former showed a substantial spike in a number of defects after about 500 cycles.

Automatic contact etching (ACE) is a process whereby periodically and in a triggered and controlled fashion, the clamshell cup bottom configured in a cup/cone open configuration is immersed into the plating bath of the tool. In this way the contacts are exposed to the electrolyte, and any plated metal is "etched" away. After the etching, the clamshell, still in the open configuration, is sprayed with rinsate while spinning to remove the electrolyte for the cup bottom and the rest of the assembly. This automatic procedure is found to be effective in maintaining and restoring the cup bottom edge region to a "clean", particle free condition. The process takes time and can add undesired water to the plating bath, so the use of the ACE operation need to be used sparingly.

Line 1806 and 1808 correspond to continuous electroplating cycling without vs. without intermediate automatic contact etching (ACE) for a cup with a lipseal that had its edge spaced only 1 mm from the sealing lip edge (D1 distance) while the distance between the contact tips and the sealing lip edge (D2 distance) was 0.75 mm. In this cup design, there is insufficient room at the edge of the wafer to move the contacts out a desired value away from the lipseal (e.g., greater than about 1.3 mm as in a combination of a 1.00 mm contact with a 1.75 mm lipseal described above). In this case, the wafers showed substantial increase in the defect count after 500 wafers when an intermediate ACE was not employed (line 1806). However, when an ACE was introduced after every $200^{th}$ cycle more than 3,000 wafer plating cycles were performed without substantial increase in particle count (line 1808). Therefore, contact etching performed in an automatic and repetitive fashion can reduce defects even in cases where there is insufficient room for contact tips to move or stay away from the lipseal area.

Figure 19:
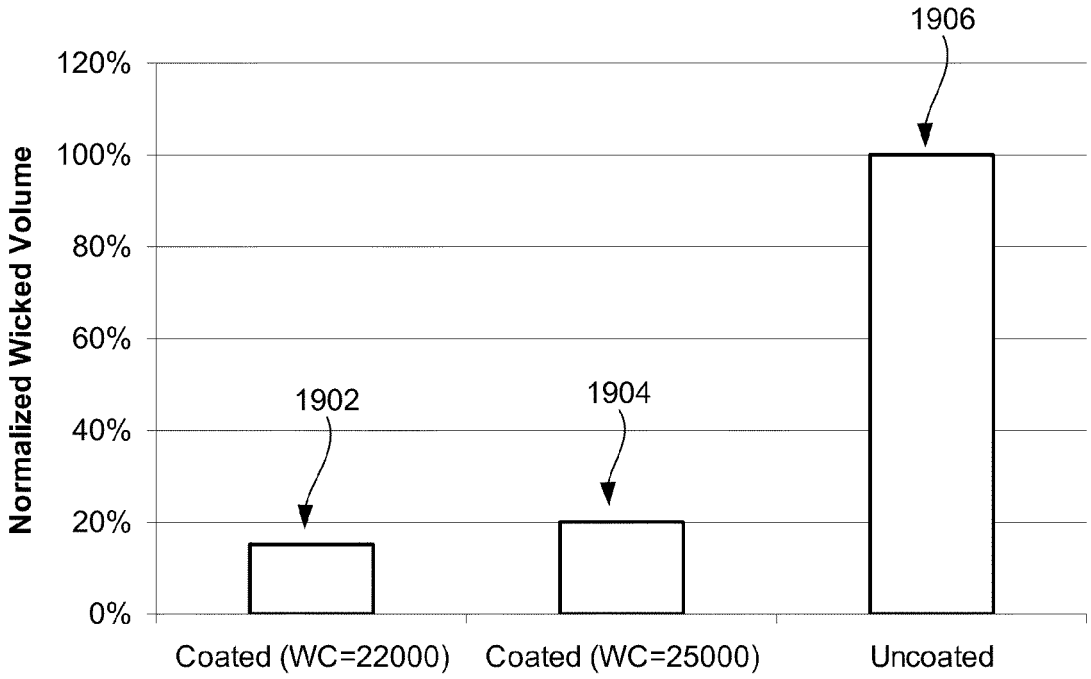
FIG. 19 is a comparative plot of the normalized wicked rinsate volume for different lipseal designs.

In certain embodiments, a lipseal is coated with a hydrophobic coating to minimize wicking of rinsate into the contact area. A hydrophobic coating may be applied to an entire lipseal surface or only around the sealing lip. A hydrophobic coating may minimize rinsate accumulation near the sealing lip after drying and reducing rinsate propagation into the contact area during opening. FIG. 19 is a comparative plot of the normalized wicked rinsate volume for different lipseal designs. The baseline (bar 1906) corresponds to a clamshell with an uncoated lipseal. Bars 1902 and 1904 correspond to clamshells with coated lipseals showing reduction in wicked volumes by at least 80%.

CONCLUSION

Although the foregoing invention has been described in some detail for purposes of clarity of understanding, it will be apparent that certain changes and modifications may be practiced within the scope of the appended claims. It should be noted that there are many alternative ways of implementing the processes, systems and apparatus of the present invention. Accordingly, the present embodiments are to be considered as illustrative and not restrictive, and the invention is not to be limited to the details given herein.

All references cited herein are incorporated by reference for all purposes

What is claimed is:

1. A base plate for use in a cup configured to hold a semiconductor wafer during electroplating and to exclude electroplating solution from reaching electrical contacts, the base plate comprising:

a ring-shaped body;

a knife-shaped protrusion extending inward from the ring-shaped body and configured to support an elastomeric lipseal for engaging the semiconductor wafer and excluding the electroplating solution from reaching the electrical contacts; and a hydrophobic coating covering at least the knife-shaped protrusion, wherein the hydrophobic coating comprises polyamide-imide (PAI).

2. The base plate of claim 1, wherein the hydrophobic coating comprises one or more materials selected from the group consisting of (PAI), polyvinylidene fluoride (PVDF), polytetrafluoroethylene (PTFE), and copolymers thereof.

3. The base plate of claim 1, wherein the hydrophobic coating further comprises polytetrafluoroethylene (PTFE).

4. The base plate of claim 1, wherein the hydrophobic coating has a thickness of between about 20 μm and 35 μm.

5. The base plate of claim 1, wherein the hydrophobic coating can pass a 90V spark test.

6. The base plate of claim 1, wherein the hydrophobic coating does not leach or absorb a detectable amount of the electrolyte solution.

7. The base plate of claim 1, wherein the ring-shaped body and the knife shaped protrusion comprise one or more materials selected from the group consisting of stainless steel, titanium, and tantalum.

8. The base plate of claim 1, wherein the ring-shaped body is configured to removably attach to a shield structure of an electroplating apparatus.

9. The base plate of claim 1, wherein the knife-shaped protrusion is configured to support at least about 200 pounds of force.

10. The base plate of claim 1, wherein the ring-shaped body comprises a groove configured to engage with a ridge on a lipseal.

11. The base plate of claim 1, wherein the hydrophobic coating comprises two layers.

12. The based plate of claim 11, wherein a first layer of the two layers comprises about 100% of polyamide-imide and wherein a second layer of the two layers comprises about 70% of polyamide-imide and about 30% of polytetrafluoroethylene.

13. The based plate of claim 12, wherein the second layer covers the first layer with respect to the knife-shaped protrusion.

14. The based plate of claim 11, wherein the hydrophobic coating further comprises one or more additional layers coating the two layers.

15. The based plate of claim 1, wherein the ring-shaped body and the knife-shaped protrusion are separated from the electrical contacts.

16. The base plate of claim 15, wherein the hydrophobic coating comprises one or more materials selected from the group consisting of (PAI), polyvinylidene fluoride (PVDF), polytetrafluoroethylene (PTFE), and copolymers thereof.

17. The base plate of claim 15, wherein the hydrophobic coating comprises polytetrafluoroethylene (PTFE).

18. The base plate of claim 15, wherein the hydrophobic coating has a thickness of between about 20 μm and 35 μm.

19. The base plate of claim 15, wherein the hydrophobic coating can pass a 90V spark test.

20. The base plate of claim 15, wherein the hydrophobic coating does not leach or absorb a detectable amount of the electrolyte solution.

21. The base plate of claim 15, wherein the ring-shaped body and the knife shaped protrusion comprise one or more materials selected from the group consisting of stainless steel, titanium, and tantalum.

22. The base plate of claim 15, wherein the ring-shaped body is configured to removably attach to a shield structure of an electroplating apparatus.

23. The base plate of claim 15, wherein the knife-shaped protrusion is configured to support at least about 200 pounds of force.

24. The base plate of claim 15, wherein the ring-shaped body comprises a groove configured to engage with a ridge on a lipseal.

25. An electroplating apparatus configured to hold a semiconductor wafer during electroplating and exclude plating solution from contacting certain parts of the electroplating apparatus, the electroplating apparatus comprising:

a cup for supporting the semiconductor wafer including a base plate comprising;

a ring-shaped body;

a knife-shaped protrusion extending inward from the ring-shaped body and configured to support an elastomeric lipseal for engaging the semiconductor wafer and excluding the electroplating solution from reaching the electrical contacts; and a hydrophobic coating covering at least the knife-shaped protrusion, wherein the hydrophobic coating comprises polyamide-imide (PAI);

a cone for exerting force on the semiconductor wafer and pressing the semiconductor wafer against the elastomeric seal; and a shaft configured to move the cone relative to the cup and to exert a force on the semiconductor wafer through the cone in order to seal the semiconductor wafer against the elastomeric seal of the cup and to rotate the cup and the cone.

26. The electroplating apparatus of claim 25 further comprising a controller including instructions for:

positioning the semiconductor wafer on the cup;

lowering the cone onto the semiconductor wafer to exert a force on the back side of the semiconductor wafer in order to establish a seal between a lipseal of the cup and the front surface of the wafer;

submerging at least a portion of the front surface of the wafer into an electroplating solution and electroplating on the front surface of the wafer; and lifting the cone to release the force from the back side of the semiconductor wafer, wherein lifting is performed over a period of at least 2 seconds.

* * * * *